US009189937B2

(12) United States Patent
Shechter

(10) Patent No.: US 9,189,937 B2
(45) Date of Patent: Nov. 17, 2015

(54) PROTECTING A MATERIAL FROM CONTAMINATION

(76) Inventor: Nir Shechter, Sde Trumot (IL)

( * ) Notice: Subject to any disclaimer, the term of this patent is extended or adjusted under 35 U.S.C. 154(b) by 1024 days.

(21) Appl. No.: 13/126,467

(22) PCT Filed: Nov. 1, 2009

(86) PCT No.: PCT/IL2009/001019

§ 371 (c)(1),
(2), (4) Date: Apr. 28, 2011

(87) PCT Pub. No.: WO2010/049938

PCT Pub. Date: May 6, 2010

(65) Prior Publication Data

US 2011/0209332 A1 Sep. 1, 2011

Related U.S. Application Data

(60) Provisional application No. 61/109,569, filed on Oct. 30, 2008.

(51) Int. Cl.
*G08B 15/00* (2006.01)

(52) U.S. Cl.
CPC ..... *G08B 15/007* (2013.01); *Y10T 29/49826* (2015.01)

(58) Field of Classification Search
CPC .... G08B 15/007; G08B 15/001; G08B 15/00; E05G 1/14; E05G 5/003; E05G 5/02; E05G 2700/04; E04H 7/02; E04H 7/22; E04H 9/16; E04H 12/003
USPC ..... 29/428, 284, 700, 592; 220/565, 566, 220/567, 567.1, 567.2, 730, 747, 748, 220/366.1, 367.1, 371, 372, 373, 374, 4.12; 454/48; 52/168, 192, 19, 20, 101, 79.1, 52/82, 127.4, 198, 218, 219, 302.1, 302.2; 43/2, 58, 59, 62; 141/97
See application file for complete search history.

(56) References Cited

U.S. PATENT DOCUMENTS

| | | | | | |
|---|---|---|---|---|---|
| 845,629 | A | * | 2/1907 | Gaynor | 109/3 |
| 951,192 | A | * | 3/1910 | Massey | 52/20 |
| 1,772,219 | A | * | 8/1930 | Kempton | 607/95 |
| 3,461,803 | A | * | 8/1969 | Johnson et al. | 417/36 |
| 4,291,486 | A | * | 9/1981 | Lindley | 43/61 |
| 5,277,799 | A | * | 1/1994 | Bransch | 210/155 |

(Continued)

*Primary Examiner* — Christopher M Koehler
(74) *Attorney, Agent, or Firm* — Mark M. Friedman

(57) ABSTRACT

Protecting material from contamination by an illicit substance or object during unauthorized or illegal action, performed by children, teenagers, animals Providing material inside a closed container having an access opening, aligning a trap with access opening, mounting aligned trap within the container, and adding decoy material to trap Closed container having access opening, for containing the material, and trap mountable within container, alignable with access opening, and suitable for holding decoy material Trap with decoy material intercepts and traps illicit substance or object introduced via access opening into container, preventing the illicit substance or object from contacting protected material inside container Unique alignment and mounting via appropriate shape, configuration, dimensions, of trap relative to access opening, and amount of decoy material, produce a protective visual illusion against a perpetrator performing unauthorized or illegal action Optional automatic in-situ testing/monitoring quality or/and quantity of decoy material in mounted trap.

20 Claims, 4 Drawing Sheets

(56) References Cited

U.S. PATENT DOCUMENTS

| | | | | |
|---|---|---|---|---|
| 5,346,093 | A * | 9/1994 | De Benedittis et al. | 220/565 |
| 6,219,959 | B1 * | 4/2001 | Hsieh | 43/59 |
| 6,613,228 | B2 * | 9/2003 | Petersen et al. | 210/541 |
| 6,644,342 | B1 * | 11/2003 | Bogan et al. | 137/364 |
| 6,732,877 | B2 * | 5/2004 | Wu et al. | 220/300 |
| 2004/0178880 | A1 * | 9/2004 | Meyer et al. | 340/5.22 |
| 2005/0151653 | A1 * | 7/2005 | Chan et al. | 340/573.2 |
| 2008/0256822 | A1 * | 10/2008 | Suzuki et al. | 34/92 |
| 2009/0308877 | A1 * | 12/2009 | David et al. | 220/567.2 |

* cited by examiner

PROTECTING A MATERIAL FROM CONTAMINATION

RELATED APPLICATIONS

This patent application is a U.S. National Phase Application of PCT/IL2009/001019 filed on Nov. 1, 2009, which claims priority of U.S 61/109,569, filed Oct. 30, 2008, the contents of which are incorporated herein by reference.

FIELD AND BACKGROUND OF THE INVENTION

The present invention relates to security of materials, and more particularly, to a method, corresponding system, and corresponding device, for protecting a material from contamination by an illicit substance or object, particularly as a result of an unauthorized or illegal act, such as that performed by children, teenagers, as well as that often performed by animals, such as by birds or insects or/and by small land animals, for example, rodents, squirrels, and snakes. The present invention is particularly applicable to a large volume, for example, of at least several hundreds of liters, and up to several millions of liters, of essentially any type of liquid or/and solid phase material, presently contained and stored, or intended to be stored, in a closed container, tank, reservoir, receptacle, or similar type of closed storage entity whose inside is potentially accessible to humans or/and animals, wherein the material may be considered at risk from contamination caused by an unauthorized or illegal act, such as that performed by children, teenagers, or animals, and therefore needs to be protected against such acts.

In a wide variety of different governmental, commercial, and private, sectors and areas of activities, a large volume, for example, of at least several hundreds of liters, and up to several millions of liters, of a given liquid or/and solid phase material is commonly contained and stored in a closed container, tank, reservoir, receptacle, or similar type of closed storage entity whose inside is accessible to humans or/and animals, herein generally and equivalently referred to as a closed internally accessible container, or as a closed container, or for brevity, as a container, of appropriate size and materials of construction. Just a few specific examples of such a stored material are water, a petroleum based liquid fuel, such as gasoline, diesel fuel, or airplane fuel, a raw or intermediate material used for processing or manufacturing a finished product, such as a human edible food product, a pharmaceutical product, or a chemical product, and a finished product obtained from completion of a manufacturing process. One or more access openings are often configured as part of the construction of the cover of the closed container. Access openings are typically used by authorized personnel for performing a variety of legitimate actions or activities. For example, for entering and providing maintenance (cleaning, repairing) to the inside of the container; for adding material from an outside source to the container; for removing material from the container to an outside receiver; for ventilating the container; for determining the level of the material inside the container; for removing a sample of the material from the container, for the purpose of testing or/and monitoring the quality of the material, for example, in terms of pre-determined parameters of physical, chemical, or/and biological, properties, characteristics, and behavior (activity), of the material; or for any combination of such authorized actions or activities.

A given large volume of a contained material is typically stored in a designated storage location, either inside or outside of a building or other type of designated storage entity, within the grounds or boundaries of a governmental, commercial, or private, property, facility, or complex. Moreover, such grounds or boundaries are typically part of an overall, multi-faceted, security environment, characterized by security conditions and arrangements involving different types and amounts of security equipment or hardware and security procedures. Commonly known and employed types of security equipment or hardware are walls, fences (non-electronic, electronic), locks (non-electronic, electronic), or similar physical barriers, security guards, guard dogs, electronic alarms, electronic visual surveillance devices such as video cameras and motion detectors, and electronic audio surveillance devices such as sound detectors. A commonly employed security procedure is based on the concept of 'response time', relating to how quickly on-site or/and off-site security personnel respond to a 'break' in a given type of security equipment or hardware in the overall secure environment.

Actual security conditions and arrangements of a given stored material depend upon several factors, such as the type, active or potential hazard level, value, size, location, accessibility, and eventual use, of the stored material. For example, a large volume of water used by a nuclear power plant, in particular, for cooling the nuclear reactor, is typically stored in an extremely high level security environment, such as one featuring all of the above types of security equipment or hardware, along with a relatively short response time to a security break. As other examples, a large volume of a petroleum based liquid fuel, such as gasoline or diesel, a large volume of a raw or intermediate material for manufacturing or processing a finished product, such as a human edible food product, a pharmaceutical product, or a chemical product, and a finished product obtained from completion of a manufacturing process, is typically stored in a moderate level security environment, such as one featuring some or most, but not all, of the above types of security equipment or hardware, along with a relatively moderate response time to a security break. Another example, particularly common in many regions of the world, is a large volume of public drinking water stored in a closed container or reservoir housed in an elevated 'water tower' type of 'stand-alone' structure, typically located within a community, a town, or a larger population center, featuring a relatively low level security environment, such as one including only fences or/and locks, without any electronic means of security, along with a relatively long response time to a security break due to the uncertainty in accurately determining the time of an actual entry through, or break of, a fence or lock by an unauthorized person or animal.

In principle, essentially any large volume of material stored in a closed container, regardless of the level of the overall security environment, at one time or another, may be considered at risk from contamination by unauthorized or illegal introduction of an illicit substance or object, for example, via an access opening in the cover of the container, as a result of an unauthorized or illegal act, such as that performed by children, teenagers, as well as that often performed by animals, such as by birds or insects or/and by small land animals, for example, rodents, squirrels, and snakes.

Herein, an illicit substance or object is any substance or object in the possession of a perpetrator or perpetrators (such as children, teenagers, or/and animals) about to perform, or in the process of performing, an unauthorized or illegal act involving introduction of that substance or object to a material stored in a closed container. Additionally, herein, an illicit substance or object may also be the perpetrator or perpetrators (such as children, teenagers, or/and animals) themselves, for example, introducing themselves, via an access opening in the cover of the container, to the material stored in the container.

For the applicable regions of the world, the large volume of public drinking water stored in a closed container or reservoir housed in a water tower type of structure is considered a highly attractive or desirable for serving as a likely target of contamination by a potential perpetrator (such as children, teenagers, or animals), but, is typically provided a relatively low level security environment including a relatively long response time to a security break. Additionally, a large volume of a petroleum based liquid fuel, or of a raw or intermediate material used for processing or manufacturing a finished product, or a finished product obtained from completion of a manufacturing process, may also be considered highly attractive or desirable for serving as likely targets of contamination by a potential perpetrator (such as children, teenagers, or animals), but, may also be stored in relatively low level security environments including a relatively long response time to a security break. Thus, for these and similar cases, there exists an anomaly, and therefore, a potential flaw or limitation, regarding the overall security environment, in general, and regarding the security conditions and arrangements, in particular, provided for protecting a given stored material.

Clearly, the type (reversible or/and irreversible) and extent of contamination by an illicit substance or object introduced into a given stored material depend upon the physical, chemical, or/and biological, properties, characteristics, and behavior (activity), and size, of the stored material, of the illicit substance or object, and of the interaction of the illicit substance or object with the stored material. Furthermore, duration of the interaction of the illicit substance or object with the stored material is another important factor determining the type and extent of contamination of the stored material. Thus, following a break in the overall security environment of the stored material and subsequent introduction of an illicit substance or object into the material, and depending upon the actual security conditions and arrangements in operation, duration of interaction of the illicit substance or object with the material is a function of (i) the time required for the security equipment or hardware to discover and identify the break in security, (ii) the additional time taken for notifying (on-site or/and off-site) security personnel, (iii) the additional time taken by the security personnel to respond to the break in security, (iv) the additional time required for notifying the appropriate materials handling personnel (typically, not the same as security personnel) for handling the contaminated material, and (v) the additional time required for properly responding to potential release of the contaminated material from the container or reservoir, and if applicable, from the designated storage location, of the contaminated material.

Moreover, and relatedly, there is the important issue regarding the type and extent of potential damage to infrastructure or/and injury (including possible death) of humans caused by exposure of these entities to the contaminated material, following possible release of the contaminated material from the storage environment. In a bad scenario, release of a contaminated material could lead to a situation of destruction of infrastructure or/and injury (including death) of humans, for example, on a large scale.

All of the above types of conventional or/and high-tech security environments, conditions, and arrangements (equipment or hardware and procedures), used for protecting a material from contamination by an illicit substance or object as a result of an unauthorized or illegal act, such as that performed by children, teenagers, as well as that often performed by animals, such as by birds or insects or/and by small land animals, for example, rodents, squirrels, and snakes, are primarily focused on discovering, identifying, and targeting, the break in security, and to a certain extent, also to slow down, impede, or obstruct, further progress or duration of, the break in security. However, once contamination by the unauthorized or illegal introduction of the illicit substance or object into the material is made, for example, via an access opening in the cover of the container, 'the clock starts ticking' regarding potential or actual damage to infrastructure or/and injury (including possible death) of humans caused by exposure of these entities to the contaminated material, following release of the contaminated material from the broken security storage environment.

Accordingly, a significant limitation which is common to all of the above types of conventional or/and high-tech security environments, conditions, and arrangements, is the lack of additional security conditions and arrangements (equipment or hardware or/and procedures), following a break in the overall security environment of the stored material, for 'preventing' contamination of the material by unauthorized or illegal introduction of an illicit substance or object into the storage container.

There is thus a need for, and it would be highly advantageous to have a method, corresponding system, and corresponding device, for protecting a material from contamination by an illicit substance or object, particularly as a result of an unauthorized or illegal act, such as that performed by children, teenagers, as well as that often performed by animals, such as by birds or insects or/and by small land animals, for example, rodents, squirrels, and snakes. There is a need for such an invention which provides security conditions (equipment or hardware and a procedure), whereupon following a break in the overall security environment of a material stored in a closed container or reservoir, operation of the invention 'prevents' contamination of the protected material by unauthorized introduction of an illicit substance or object into the storage container or reservoir. Moreover, there is a need for such an invention which is generally applicable to essentially any type and quantity (particularly large volumes) of liquid or/and solid phase material, which is generally applicable to essentially any type, and essentially any geometrical shape or configuration and dimensions, of closed storage containers, which is relatively inexpensive to fully implement, which is readily implemented in new or existing storage environments, and which is commercially applicable.

Furthermore, there is a need for such an invention which, as either part of, or separate from, ensuring the protection and security of the material, optionally, may additionally be implemented for automatically in-situ testing or/and monitoring the quality or/and quantity (amount) of the decoy material in the mounted (and aligned or non-aligned) trap, in particular, by testing or/and monitoring pre-determined parameters of physical, chemical, or/and biological, properties, characteristics, and behavior (activity), or/and, level (height), of the decoy material therein.

SUMMARY OF THE INVENTION

The present invention relates to a method, corresponding system, and corresponding device, for protecting a material from contamination by an illicit substance or object, particularly as a result of an unauthorized or illegal act, such as that performed by children, teenagers, as well as that often performed by animals, such as by birds or insects or/and by small land animals, for example, rodents, squirrels, and snakes.

The method for protecting a material from contamination by an illicit substance or object, of the present invention, includes the following main steps and components thereof: (a) providing the material inside a closed container having an access opening, (b) aligning a trap with the access opening, (c) mounting the aligned trap within the container, and (d) adding an amount of decoy material to the trap, such that the trap with the decoy material intercepts and traps the illicit substance or object introduced via the access opening into the container, thereby preventing the illicit substance or object from coming into contact with the protected material inside the container. As illustratively described herein below, in a non-limiting manner, the main steps of the preferred embodiment of the method of the present invention, Steps (a) through (d), are performed according to a variety of several different ways and sequences.

For embodiments or configurations of the method, wherein, ordinarily, a given access opening is operatively connected to closure or covering components and means, for example, a closure or covering element, such as a cover, for partially or entirely closing or covering, and for re-opening, the access opening, according to specific need or/and application, then, the method of the present invention further includes the optional, additional step of automatically sensing an opened or closed configuration, and extent thereof, of the closure or covering components and means of the access opening.

Alternatively, or additionally, for such embodiments or configurations of the method, wherein, ordinarily, a given access opening is operatively connected to closure or covering components and means, for example, a closure or covering element, such as a cover, for partially or entirely closing or covering, and for re-opening, the access opening, according to specific need or/and application, then, the method of the present invention further includes the optional, additional step of providing locking/unlocking components and means, being operatively connectable to the access opening or/and operatively connectable to the closure or covering components and means of the access opening, for locking or unlocking the closure or covering components and means of the access opening.

The method of the present invention further includes the optional, additional step of automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

The corresponding system for protecting a material from contamination by an illicit substance or object, of the present invention, includes the following main components and functionalities thereof: (a) a closed container having an access opening, for containing the material, and (b) a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

For embodiments or configurations of the system, wherein, ordinarily, a given access opening is operatively connected to closure or covering components and means, for example, a closure or covering element, such as a cover, for partially or entirely closing or covering, and for re-opening, the access opening, according to specific need or/and application, then, the corresponding system of the present invention, optionally, additionally includes an opened/closed configuration type of sensing assembly, being operatively connectable to the access opening, or/and operatively connectable to the closure or covering components and means of the access opening, for automatically sensing an opened or closed configuration, and extent thereof, of the closure or covering components and means.

Alternatively, or additionally, for such embodiments or configurations of the system, wherein, ordinarily, a given access opening is operatively connected to closure or covering components and means, for example, a closure or covering element, such as a cover, for partially or entirely closing or covering, and for re-opening, the access opening, according to specific need or/and application, then, the corresponding system of the present invention, optionally, additionally includes locking/unlocking components and means, being operatively connectable to the access opening or/and operatively connectable to the closure or covering components and means of the access opening, for locking or unlocking the closure or covering components and means of the access opening.

The corresponding system of the present invention, optionally, additionally includes a material quality or/and quantity testing or/and monitoring assembly, being operatively connectable to the mounted (and aligned or non-aligned) trap, and operatively contactable with the decoy material therein, for automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

The corresponding device for protecting a material within a closed container having an access opening, from contamination by an illicit substance or object introduced into the container, of the present invention, includes the following main components and functionalities thereof: a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

The corresponding device (i.e., trap), of the present invention, additionally includes a material quality or/and quantity testing or/and monitoring assembly, being operatively connectable to the mounted (and aligned or non-aligned) trap, and operatively contactable with the decoy material therein, for automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

Implementing the method, corresponding system, or/and corresponding device, with the optional automatically sensing an opened or closed configuration, and extent thereof, of the closure or covering components and means of the access opening; or/and with the optional locking or unlocking the closure or covering components and means of the access opening; or/and with the optional automatically in-situ testing or/and monitoring the quality or/and quantity (amount) of the decoy material in the mounted (and aligned or non-aligned) trap, is/are performed, preferably, by interfacing and communicating with, and being controlled by, a work station.

In general, the work station includes any number and kinds or types of human operators, or/and includes any number and kinds or types of fully automatic or/and semi-automatic mechanized type operators. Moreover, the work station includes any number and kinds or types of fixed or/and portable (mobile) computers or/and computerized equipment, and computer software, and includes any number and kinds or types of fixed or/and portable (mobile) communication equipment (e.g., land-line phones or/and mobile or cellular phones, and associated software components thereof), which may be needed for on-site (locally) or/and off-site (distantly) performing the interfacing, communicating, and controlling, of the optional automatically sensing an opened or closed configuration, and extent thereof, of the closure or covering components and means of the access opening; or/and of the optional locking or unlocking the closure or covering components and means of the access opening; or/and of the optional automatically in-situ testing or/and monitoring the quality or/and quantity (amount) of the decoy material in the mounted (and aligned or non-aligned) trap.

Such interfacing, communicating, and controlling, are effected according to a temporal mode or/and protocol selected from the group consisting of a temporally continuous mode or/and protocol, a temporally discontinuous (i.e., periodic or sporadic) mode or/and protocol, and a combination thereof. Such interfacing, communicating, and controlling, are effected according to a mode or/and protocol selected from the group consisting of a wired mode or/and protocol, a wireless mode or/and protocol, and a combination thereof.

The present invention provides novel, inventive, and highly effective, security conditions, whereupon following a break in the overall security environment of the stored material, operation of the invention 'prevents' contamination of the protected material by unauthorized or illegal introduction of an illicit substance or object into the storage container.

The present invention features the novel and inventive use of a trap, for example, in the form of a tray or tray-like configuration, specially alignable with an access opening of a closed container containing a material, mountable within the closed container, for example, according to a fixed, non-movable mounting configuration, using fixed, non-movable mounting means, or according to a non-fixed, movable mounting configuration, using non-fixed, movable mounting means, and, suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

Aligning the trap with the access opening of the container, and mounting the aligned trap within the container, are performed according to a specifically designed three-dimensional geometrical and dimensional configuration, which accounts for the geometrical shape or configuration and dimensions of the trap relative to the geometrical shape or configuration and dimensions of the access opening, in addition to the amount (especially with respect to the visibly exposed surface area) of the decoy material added to, and contained by, the trap, in order to generate a 'protective' type of visual illusion directed against the perpetrator (for example, child, teenager, or animal) of the unauthorized or illegal act introducing the illicit substance or object via the access opening into the container. When the trap is appropriately aligned with the access opening of the container, followed by being mounted therein, a perpetrator of the unauthorized or illegal act introducing the illicit substance or object via the access opening into the container 'is able to see' only the contents, that is, the decoy material, inside the trap, and 'is not able to see' any part of the mounting components of the trap, and 'is not able to see' any of the protected material inside the container. In other words, the trap is aligned with the access opening in a particular manner such that the maximum possible view or range of sight of the perpetrator of the unauthorized or illegal act, before, during, and after, the time of committing the unauthorized or illegal act, is limited to that of only the exposed portion of the decoy material inside the trap, whereby all of the mounting components of the trap, and all of the protected material inside the container, are entirely outside of this view or range of sight of the perpetrator.

Accordingly, while the unauthorized or illegal act is taking place, during the time the perpetrator introduces the illicit substance or object via the access opening into the container, operation of the present invention includes generation of a 'protective' type of visual illusion. The perpetrator (child, teenager, or animal) is unknowingly provided with a visual illusion and thinks that by his introducing the illicit substance or object into the container, the illicit substance or object will come into direct contact with the protected material inside the container, where in reality, by operation of the present invention, the aligned and mounted trap, holding the decoy material therein, intercepts and traps the illicit substance or object introduced into the container, and prevents the illicit substance or object from coming into contact with the protected material inside the container, without the perpetrator being aware of this.

Preferably, geometrical shape or configuration and dimensions of the trap relative to geometrical shape or configuration and dimensions of the access opening, in addition to the amount (especially with respect to the visibly exposed surface area) of the decoy material added to and contained in the trap, are selected and used for enabling such a particular type of alignment, and subsequent mounting, for assuring proper production of the visual illusion, and therefore, for assuring proper operation of the invention.

Thus, in the event of a break in the overall security environment of a material stored in a container, the present invention provides a specific local and instantaneous type of solution, in particular, in the immediate region or vicinity of potential contact between an illicit substance or object and a material being protected, while an unauthorized or illegal act is taking place, to the general, and often multi-faceted, problem of protecting the material from contamination by the illicit substance or object as a result of the unauthorized or illegal act such as that performed by children, teenagers, as well as that often performed by animals, such as by birds or insects or/and by small land animals, for example, rodents, squirrels, and snakes.

The present invention provides security conditions (equipment or hardware and a procedure), whereupon following a break in the overall security environment of a material stored in a closed container or reservoir, operation of the present invention 'prevents' contamination of the protected material by unauthorized introduction of an illicit substance or object into the storage container or reservoir. Moreover, the present invention is generally applicable to essentially any type and quantity (particularly large volumes) of liquid or/and solid phase material, is generally applicable to essentially any type, and essentially any geometrical shape or configuration and dimensions, of closed storage containers, is relatively inexpensive to fully implement, is readily implemented in new or existing storage environments, and is commercially applicable.

The present invention is particularly applicable to a wide variety of different governmental, commercial, and private, sectors and areas of activities, wherein a large volume, for example, of at least several hundreds of liters, and up to several millions of liters, of essentially any type of liquid or/and solid phase material, is currently contained and stored or is intended to be contained and stored, in a closed container, tank, reservoir, receptacle, or similar type of closed storage entity whose inside is potentially accessible to humans, wherein the material may be considered at risk from contamination caused by an unauthorized or illegal act, such as that performed by children, teenagers, as well as that often performed by animals, and therefore needs to be protected against such acts.

A few well known specific examples of such a stored material are water, a petroleum based liquid fuel, such as gasoline, diesel fuel, or airplane fuel, a raw or intermediate material used for processing or manufacturing a finished product, such as a human edible food product, a pharmaceutical product, or a chemical product, and a finished product obtained from completion of a manufacturing process.

The present invention, as either part of, or separate from, ensuring the protection and security of the material, optionally, may additionally be implemented for automatically in-situ testing or/and monitoring the quality or/and quantity (amount) of the decoy material in the mounted (and aligned or non-aligned) trap, in particular, by testing or/and monitoring pre-determined parameters of physical, chemical, or/and biological, properties, characteristics, and behavior (activity), or/and, level (height), of the decoy material therein.

Thus, according to the present invention, there is provided a method for protecting a material from contamination by an illicit substance or object, comprising the steps of (a) providing the material inside a closed container having an access opening; (b) aligning a trap with the access opening; (c) mounting the aligned trap within the container; and (d) adding an amount of decoy material to the trap, such that the trap with the decoy material intercepts and traps the illicit substance or object introduced via the access opening into the container, thereby preventing the illicit substance or object from coming into contact with the protected material inside the container.

According to another aspect of the present invention, there is provided a system for protecting a material from contamination by an illicit substance or object, comprising: (a) a closed container having an access opening, for containing the material; and (b) a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

According to another aspect of the present invention, there is provided a device for protecting a material contained within a closed container having an access opening from contamination by an illicit substance or object introduced into the container, comprising: a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

According to further characteristics in preferred embodiments of the invention described below, the material in the container is selected from the group consisting of a liquid phase material, a solid phase material, and a combination thereof.

According to further characteristics in preferred embodiments of the invention described below, the container is a type selected from the group consisting of a tank, a reservoir, a receptacle, and a similar type of closed storage entity.

According to further characteristics in preferred embodiments of the invention described below, the access opening is a type selected from the group consisting of an access opening for entering and providing maintenance to inside of the container, an access opening for adding the material to the container or/and for removing the material from the container, an access opening for ventilating the container, an access opening for determining level of the material, and a combination thereof.

According to further characteristics in preferred embodiments of the invention described below, the access opening is part of a cover of the container.

According to further characteristics in preferred embodiments of the invention described below, the trap is in a form of a tray or a tray-like structure.

According to further characteristics in preferred embodiments of the invention described below, the materials of construction of the trap are selected from the group consisting of plastic, rubber, metal, cement, glass, composite material, and combinations thereof.

According to further characteristics in preferred embodiments of the invention described below, the trap is made of a plastic material.

According to further characteristics in preferred embodiments of the invention described below, the plastic material is selected from the group consisting of a polypropylene material, a polyethylene material, a polycarbonate material, a Teflon material, and a combination thereof.

According to further characteristics in preferred embodiments of the invention described below, the dimensions (length, width, height or depth, diameter, perimeter) of the trap are proportionately larger than, and encompass, dimensions of the access opening.

According to further characteristics in preferred embodiments of the invention described below, the magnitude of each of length and width of the trap is in a range of between about 1.2 to about 2.0 times magnitude of corresponding length and width of the access opening.

According to further characteristics in preferred embodiments of the invention described below, the magnitude of each of length and width of the trap is about 1.5 times magnitude of corresponding length and width of the access opening.

According to further characteristics in preferred embodiments of the invention described below, the trap includes a screen attached to, and encompassing perimeter of, upper end or top portion of walls of the trap, for assisting the trap for the intercepting and the trapping the illicit substance or object.

According to further characteristics in preferred embodiments of the invention described below, the trap is aligned with the access opening according to a specifically designed three-dimensional geometrical and dimensional relative configuration, accounting for geometrical shape or configuration and dimensions of the trap relative to geometrical shape or configuration and dimensions of the access opening, such that there is generating a protective type of visual illusion directed against a perpetrator of the unauthorized or illegal act introducing the illicit substance or object via the access opening into the container.

According to further characteristics in preferred embodiments of the invention described below, the trap is aligned with the access opening according to a specifically designed three-dimensional geometrical and dimensional relative configuration, accounting for geometrical shape or configuration and dimensions of the trap relative to geometrical shape or configuration and dimensions of the access opening, in combination with the amount of the decoy material in the trap, such that there is generating a protective type of visual illusion directed against a perpetrator of the unauthorized or illegal act introducing the illicit substance or object via the access opening into the container.

According to further characteristics in preferred embodiments of the invention described below, the trap is aligned with the access opening in a manner such that a perpetrator of the unauthorized or illegal act introducing the illicit substance or object via the access opening into the container is able to see only exposed portion of the decoy material inside the trap, and is not able to see any part of mounting components of the aligned and mounted trap, and is not able to see any part of the protected material inside the container.

According to further characteristics in preferred embodiments of the invention described below, the trap is aligned with the access opening in a manner such that maximum possible view or range of sight of a perpetrator of the unauthorized or illegal act is limited to only exposed portion of the decoy material inside the trap, whereby all mounting components of the trap, and all of the protected material inside the container, are entirely outside of the view or range of sight of the perpetrator.

According to further characteristics in preferred embodiments of the invention described below, the trap is aligned with the access opening in a manner such that the trap is co-axially aligned with the access opening of the container, whereby central longitudinal axis of the trap is aligned and coincident with central longitudinal axis of the access opening, such that the trap and the access opening have same central longitudinal axis.

According to further characteristics in preferred embodiments of the invention described below, the trap is aligned with the access opening in a manner such that opening of the trap oriented towards and facing underside of a cover of the container is aligned with bottom portion of the access opening oriented towards and facing towards bottom of inside of the container.

According to further characteristics in preferred embodiments of the invention described below, the amount of decoy material contained in the trap occupies a volume of the trap which at least covers entire bottom and at least part of side walls inside of the trap.

According to further characteristics in preferred embodiments of the invention described below, the lower end portion of the access opening facing towards top exposed portion of the decoy material is selected from the group of being in direct contact with the decoy material, and being separated from and above the decoy material.

According to further characteristics in preferred embodiments of the invention described below, the trap is held and mounted in a trap holder within the container.

According to further characteristics in preferred embodiments of the invention described below, the magnitude of each of length and width of the trap holder is in a range of between about 1.01 to about 1.5 times magnitude of corresponding length and width of the trap.

According to further characteristics in preferred embodiments of the invention described below, the magnitude of each of length and width of the trap holder is about 1.1 times magnitude of corresponding length and width of the trap.

According to further characteristics in preferred embodiments of the invention described below, the trap holder is foldable into two parts, when the trap is not being held by the trap holder.

According to further characteristics in preferred embodiments of the invention described below, the aligned trap is mounted within the container according to a fixed, non-movable mounting configuration relative to the access opening.

According to further characteristics in preferred embodiments of the invention described below, the aligned trap is mounted within the container according to a non-fixed, movable mounting configuration relative to the access opening.

According to further characteristics in preferred embodiments of the invention described below, the decoy material is selected from the group consisting of a liquid phase material, a solid phase material, and a combination thereof.

According to further characteristics in preferred embodiments of the invention described below, the decoy material is selected from the group consisting of sand, earth, and a type of material which is generally inert to, or at most, only mildly reactive with, the illicit substance or object.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice. In the drawings.

DESCRIPTION OF THE PREFERRED EMBODIMENTS

Figure 1:
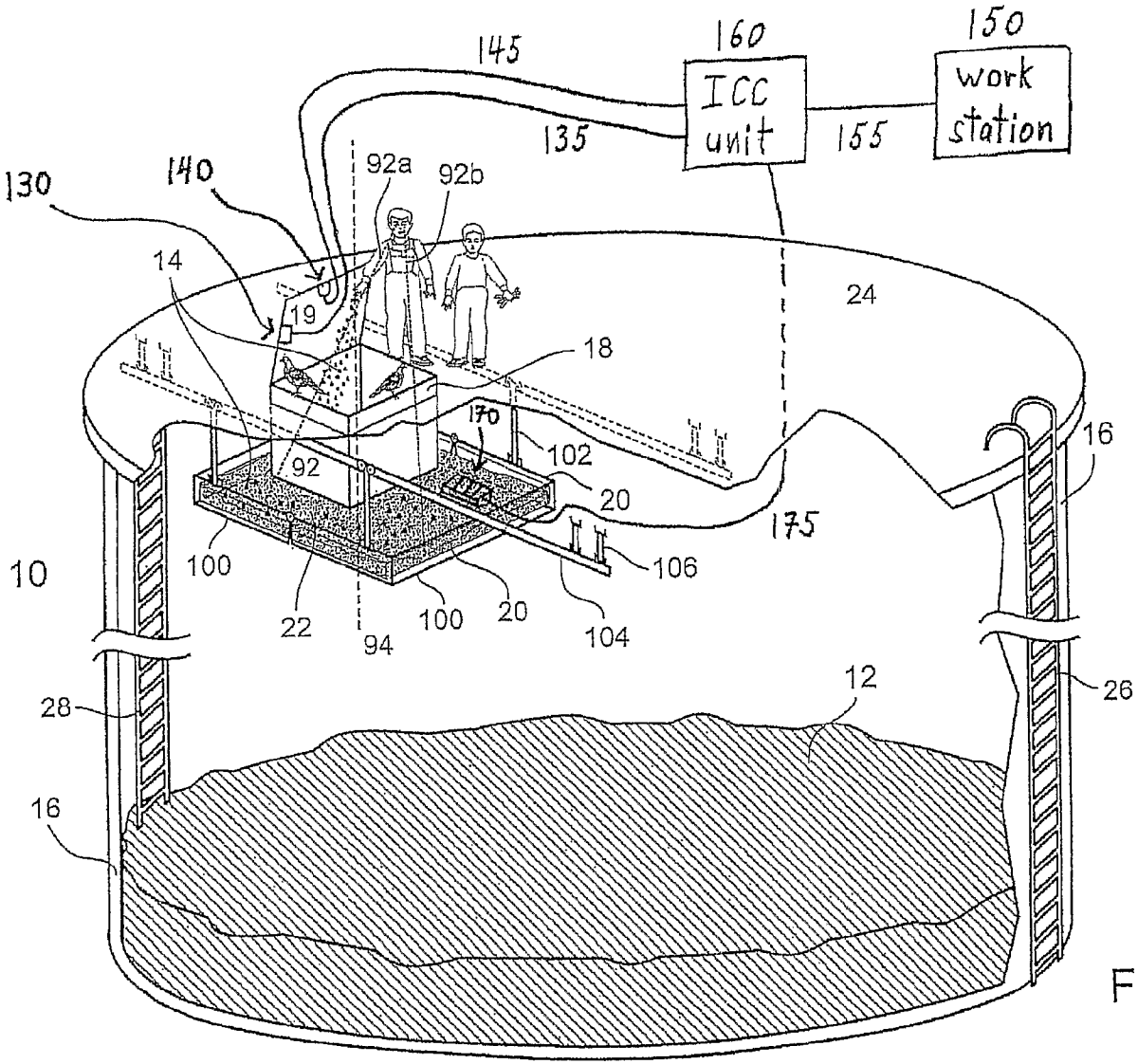
FIG. 1 is a schematic diagram illustrating a cut away perspective view of the fully operative state of an exemplary preferred embodiment of the corresponding system, used for implementing the method for protecting a material from contamination by an illicit substance or object, in accordance with the present invention.

The present invention relates to a method, corresponding system, and corresponding device, for protecting a material from contamination by an illicit substance or object, particularly as a result of an unauthorized or illegal act, such as that performed by children, teenagers, as well as that often performed by animals, such as by birds or insects or/and by small land animals, for example, rodents, squirrels, and snakes.

The method for protecting a material from contamination by an illicit substance or object, of the present invention, includes the following main steps and components thereof: (a) providing the material inside a closed container having an access opening, (b) aligning a trap with the access opening, (c) mounting the aligned trap within the container, and (d) adding an amount of decoy material to the trap, such that the trap with the decoy material intercepts and traps the illicit substance or object introduced via the access opening into the container, thereby preventing the illicit substance or object from coming into contact with the protected material inside the container. As illustratively described herein below, in a non-limiting manner, the main steps of the preferred embodiment of the method of the present invention, Steps (a) through (d), are performed according to a variety of several different ways and sequences.

For embodiments or configurations of the method, wherein, ordinarily, a given access opening is operatively connected to closure or covering components and means, for example, a closure or covering element, such as a cover, for partially or entirely closing or covering, and for re-opening, the access opening, according to specific need or/and application, then, the method of the present invention further includes the optional, additional step of automatically sensing an opened or closed configuration, and extent thereof, of the closure or covering components and means of the access opening.

Alternatively, or additionally, for such embodiments or configurations of the method, wherein, ordinarily, a given access opening is operatively connected to closure or covering components and means, for example, a closure or covering element, such as a cover, for partially or entirely closing or covering, and for re-opening, the access opening, according to specific need or/and application, then, the method of the present invention further includes the optional, additional step of providing locking/unlocking components and means, being operatively connectable to the access opening or/and operatively connectable to the closure or covering components and means of the access opening, for locking or unlocking the closure or covering components and means of the access opening.

The method of the present invention further includes the optional, additional step of automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

The corresponding system for protecting a material from contamination by an illicit substance or object, of the present invention, includes the following main components and functionalities thereof: (a) a closed container having an access opening, for containing the material, and (b) a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

For embodiments or configurations of the system, wherein, ordinarily, a given access opening is operatively connected to closure or covering components and means, for example, a closure or covering element, such as a cover, for partially or entirely closing or covering, and for re-opening, the access opening, according to specific need or/and application, then, the corresponding system of the present invention, optionally, additionally includes an opened/closed configuration type of sensing assembly, being operatively connectable to the access opening, or/and operatively connectable to the closure or covering components and means of the access opening, for automatically sensing an opened or closed configuration, and extent thereof, of the closure or covering components and means.

Alternatively, or additionally, for such embodiments or configurations of the system, wherein, ordinarily, a given access opening is operatively connected to closure or covering components and means, for example, a closure or covering element, such as a cover, for partially or entirely closing or covering, and for re-opening, the access opening, according to specific need or/and application, then, the corresponding system of the present invention, optionally, additionally includes locking/unlocking components and means, being operatively connectable to the access opening or/and operatively connectable to the closure or covering components and means of the access opening, for locking or unlocking the closure or covering components and means of the access opening.

The corresponding system of the present invention, optionally, additionally includes a material quality or/and quantity testing or/and monitoring assembly, being operatively connectable to the mounted (and aligned or non-aligned) trap, and operatively contactable with the decoy material therein, for automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

The corresponding device for protecting a material within a closed container having an access opening, from contamination by an illicit substance or object introduced into the container, of the present invention, includes the following main components and functionalities thereof: a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

The corresponding device (i.e., trap), of the present invention, additionally includes a material quality or/and quantity testing or/and monitoring assembly, being operatively connectable to the mounted (and aligned or non-aligned) trap, and operatively contactable with the decoy material therein, for automatically in-situ testing or/and monitoring the quality or/and quantity (amount) of the decoy material in the mounted (and aligned or non-aligned) trap. The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

Implementing the method, corresponding system, or/and corresponding device, with the optional automatically sensing an opened or closed configuration, and extent thereof, of the closure or covering components and means of the access opening; or/and with the optional locking or unlocking the closure or covering components and means of the access opening; or/and with the optional automatically in-situ testing or/and monitoring the quality or/and quantity (amount) of the decoy material in the mounted (and aligned or non-aligned) trap, is/are performed, preferably, by interfacing and communicating with, and being controlled by, a work station.

In general, the work station includes any number and kinds or types of human operators, or/and includes any number and kinds or types of fully automatic or/and semi-automatic mechanized type operators. Moreover, the work station includes any number and kinds or types of fixed or/and portable (mobile) computers or/and computerized equipment, and computer software, and includes any number and kinds or types of fixed or/and portable (mobile) communication equipment (e.g., land-line phones or/and mobile or cellular phones, and associated software components thereof), which may be needed for on-site (locally) or/and off-site (distantly) performing the interfacing, communicating, and controlling, of the optional automatically sensing an opened or closed configuration, and extent thereof, of the closure or covering components and means of the access opening; or/and of the optional locking or unlocking the closure or covering components and means of the access opening; or/and of the optional automatically in-situ testing or/and monitoring the quality or/and quantity (amount) of the decoy material in the mounted (and aligned or non-aligned) trap.

Such interfacing, communicating, and controlling, are effected according to a temporal mode or/and protocol selected from the group consisting of a temporally continuous mode or/and protocol, a temporally discontinuous (i.e., periodic or sporadic) mode or/and protocol, and a combination thereof. Such interfacing, communicating, and controlling, are effected according to a mode or/and protocol selected from the group consisting of a wired mode or/and protocol, a wireless mode or/and protocol, and a combination thereof.

Herein, a closed container, tank, reservoir, receptacle, or similar type of closed storage entity whose inside is potentially accessible to humans, which is of appropriate size and materials of construction, and is currently used for containing and storing or is intended for containing and storing a large volume, for example, of at least several hundreds of liters, and up to several millions of liters, of essentially any type of liquid or/and solid phase material, is herein generally and equivalently referred to as a closed internally accessible container, or as a closed container, or for brevity, as a container.

One or more access openings are often configured as part of the construction of the cover of the closed container. Access openings are typically used by authorized personnel for performing a variety of legitimate actions or activities. For example, for entering and providing maintenance (cleaning, repairing) to the inside of the container; for adding material from an outside source to the container; for removing material from the container to an outside receiver; for ventilating the container; for determining the level of the material inside the container; for removing a sample of the material from the container, for the purpose of testing or/and monitoring the quality of the material, for example, in terms of pre-determined parameters of physical, chemical, or/and biological, properties, characteristics, and behavior (activity), of the material; or for any combination of such authorized actions or activities.

In principle, essentially any large volume of material stored in a closed container, regardless of the level of the overall security environment, at one time or another, may be considered at risk from contamination by unauthorized or illegal introduction of an illicit substance or object, for example, via an access opening in the cover of the container, as a result of an unauthorized or illegal act, such as that performed by children, teenagers, as well as that often performed by animals, such as by birds or insects or/and by small land animals, for example, rodents, squirrels, and snakes.

Herein, an illicit substance or object is any substance or object in the possession of a perpetrator or perpetrators (such as children, teenagers, or/and animals) about to perform, or in the process of performing, an unauthorized or illegal act involving introduction of that substance or object to a material stored in a closed container. Additionally, herein, an illicit substance or object may also be the perpetrator or perpetrators (such as children, teenagers, or/and animals) themselves, for example, introducing themselves, via an access opening in the cover of the container, to the material stored in the container. Such a substance or object, introduced to the material stored in the closed container has the potential for adversely affecting, changing, or contaminating, the stored material, and therefore, has the potential for producing a dangerous situation in the event humans or/and animals come in contact with the affected, changed, or contaminated, stored material.

The present invention provides novel, inventive, and highly effective, security conditions, whereupon following a break in the overall security environment of the stored material, operation of the invention 'prevents' contamination of the material by unauthorized or illegal introduction of an illicit substance or object into the storage container.

The present invention features the novel and inventive use of a trap, for example, in the form of a tray or tray-like configuration, specially alignable with an access opening of a closed container containing a material, mountable within the closed container, for example, according to a fixed, non-movable mounting configuration, using fixed, non-movable mounting means, or according to a non-fixed, movable mounting configuration, using non-fixed, movable mounting means, and, suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

Aligning the trap with the access opening of the container, and mounting the aligned trap within the container, are performed according to a specifically designed three-dimensional geometrical and dimensional configuration, which accounts for the geometrical shape or configuration and dimensions of the trap relative to the geometrical shape or configuration and dimensions of the access opening, in addition to the amount (especially with respect to the visibly exposed surface area) of the decoy material added to, and contained by, the trap, in order to generate a 'protective' type of visual illusion directed against the perpetrator (for example, child, teenager, or animal) of the unauthorized or illegal act introducing the illicit substance or object via the access opening into the container. When the trap is appropriately aligned with the access opening of the container, followed by being mounted therein, a perpetrator of the unauthorized or illegal act introducing the illicit substance or object via the access opening into the container 'is able to see' only the exposed portion of the decoy material inside the trap, and 'is not able to see' any part of the mounting components of the trap, and 'is not able to see' any of the protected material inside the container. In other words, the trap is aligned with the access opening in a particular manner such that the maximum possible view or range of sight of the perpetrator of the unauthorized or illegal act, before, during, and after, the time of committing the unauthorized or illegal act, is limited to that of only the exposed portion of the decoy material inside the trap, whereby all of the mounting components of the trap, and all of the protected material inside the container, are entirely outside of this view or range of sight of the perpetrator.

Accordingly, while the unauthorized or illegal act is taking place, during the time the perpetrator introduces the illicit substance or object via the access opening into the container, operation of the present invention includes generation of a 'protective' type of visual illusion. The perpetrator (child, teenager, or animal) is unknowingly provided with a visual illusion and thinks that by his introducing the illicit substance or object into the container, the illicit substance or object will come into direct contact with the protected material inside the container, where in reality, by operation of the present invention, the aligned and mounted trap, holding the decoy material therein, intercepts and traps the illicit substance or object introduced into the container, and prevents the illicit substance or object from coming into contact with the protected material inside the container, without the perpetrator being aware of this.

Preferably, geometrical shape or configuration and dimensions of the trap relative to geometrical shape or configuration and dimensions of the access opening, in addition to the amount (especially with respect to the visibly exposed surface area) of the decoy material added to and contained in the trap, are selected and used for enabling such a particular type of alignment, and subsequent mounting, for assuring proper production of the visual illusion, and therefore, for assuring proper operation of the invention.

Thus, in the event of a break in the overall security environment of a material stored in a container, the present invention provides a specific local and instantaneous type of solution, in particular, in the immediate region or vicinity of potential contact between an illicit substance or object and a material being protected, while an unauthorized act is taking place, to the general, and often multi-faceted, problem of protecting the material from contamination by the illicit substance or object as a result of the unauthorized or illegal act, such as that performed by children, teenagers, as well as that often performed by animals, such as by birds or insects or/and by small land animals, for example, rodents, squirrels, and snakes.

When the system is in 'active' operation for actively protecting the material, the aligned and mounted trap, and decoy material therein, remain in a constant position relative to the access opening within the container, regardless of whether the trap is mounted according to a non-movable mounting configuration or according to a movable mounting configuration. When the system is not in 'active' operation for actively protecting the material, the system can be readily subjected to maintenance or service by authorized personnel. Exemplary primary maintenance or service activities are inspecting, repairing, or/and replacing, the trap, as well as inspecting, adding, removing, or replacing, the decoy material inside of the trap. Such maintenance or service activities are performed by the authorized personnel in an appropriate manner according to whether the trap is mounted in a non-movable mounting configuration or in a movable mounting configuration.

For the particular embodiment wherein the trap is mounted according to a non-movable mounting configuration, there is providing maintenance or service to the trap, or/and the decoy material therein, 'as is', that is, in the same (three dimensional) spatial position and configuration that the trap was initially aligned relative to the access opening and mounted within the container. For the particular embodiment wherein the trap is mounted according to a movable mounting configuration, there is providing maintenance or service to the trap, or/and the decoy material therein, by using the movable mounting means for laterally or horizontally sliding the trap to a lateral or horizontal position different from which the trap was initially aligned relative to the access opening and mounted within the container. In particular, to a lateral or horizontal position wherein the trap is at least partly moved away and clear from that part of the access opening extending beneath the cover of the container, thereby enabling the authorized personnel to have easy access for providing maintenance or service to the trap, or/and decoy material therein, for example, for inspecting, repairing, or/and replacing, the trap, or/and for inspecting, adding, removing, or replacing, the decoy material inside of the trap.

The present invention provides security conditions (equipment or hardware and a procedure), whereupon following a break in the overall security environment of a material stored in a closed container or reservoir, operation of the present invention 'prevents' contamination of the protected material by unauthorized introduction of an illicit substance or object into the storage container or reservoir. Moreover, the present invention is generally applicable to essentially any type and quantity (particularly large volumes) of liquid or/and solid phase material, is generally applicable to essentially any type, and essentially any geometrical shape or configuration and dimensions, of closed storage containers, is relatively inexpensive to fully implement, is readily implemented in new or existing storage environments, and is commercially applicable.

The present invention is particularly applicable to a wide variety of different governmental, commercial, and private, sectors and areas of activities, wherein a large volume, for example, of at least several hundreds of liters, and up to several millions of liters, of essentially any type of liquid or/and solid phase material, is currently contained and stored or is intended to be contained and stored, in a closed container, tank, reservoir, receptacle, or similar type of closed storage entity whose inside is potentially accessible to humans, wherein the material may be considered at risk from contamination caused by an unauthorized or illegal act, such as that performed by children, teenagers, as well as that often performed by animals, and therefore needs to be protected against such acts.

A few well known specific examples of such a stored material are water, a petroleum based liquid fuel, such as gasoline, diesel fuel, or airplane fuel, a raw or intermediate material used for processing or manufacturing a finished product, such as a human edible food product, a pharmaceutical product, or a chemical product, and a finished product obtained from completion of a manufacturing process.

The present invention, as either part of, or separate from, ensuring the protection and security of the material, optionally, may additionally be implemented for automatically in-situ testing or/and monitoring the quality or/and quantity (amount) of the decoy material in the mounted (and aligned or non-aligned) trap, in particular, by testing or/and monitoring pre-determined parameters of physical, chemical, or/and biological, properties, characteristics, and behavior (activity), or/and, level (height), of the decoy material therein.

It is to be understood that the present invention is not limited in its application to the details of the order or sequence, and number, of procedures, steps, and sub-steps, of operation or implementation of the method, or to the details of type, composition, construction, arrangement, order, and number, of the assemblies, sub-assemblies, mechanisms, structures, components, elements, and configurations, and, peripheral equipment, utilities, accessories, and materials, of the system and device, set forth in the following illustrative description and accompanying drawings, unless otherwise specifically stated herein. The present invention is capable of other embodiments and of being practiced or carried out in various ways. Although procedures, steps, sub-steps, and, system and device assemblies, sub-assemblies, mechanisms, structures, components, elements, and configurations, and, peripheral equipment, utilities, accessories, and materials, which are equivalent or similar to those illustratively described herein can be used for practicing or testing the present invention, suitable procedures, steps, sub-steps, and, system and device assemblies, sub-assemblies, mechanisms, structures, components, elements, and configurations, and, peripheral equipment, utilities, accessories, and materials, are illustratively described and exemplified herein.

It is also to be understood that all technical and scientific words, terms, or/and phrases, used herein throughout the present disclosure have either the identical or similar meaning as commonly understood by one of ordinary skill in the art to which this invention belongs, unless otherwise specifically defined or stated herein. Phraseology, terminology, and, notation, employed herein throughout the present disclosure are for the purpose of description and should not be regarded as limiting. For example, in the following description the terms 'closed internally accessible container', 'closed container', and 'container', are particularly used for referring to a closed, but internally accessible, entity or structure which contains or holds and stores the material which is protected by operation of the present invention, in order to illustrate implementation of the present invention. The terms 'tray' and 'tray-like' are intended to represent exemplary entities or structures of the trap of the present invention. The terms 'intercept(s)' and 'intercepting' are particularly used for referring to stopping, terminating, deflecting, or interrupting, the progress or intended course of the path or trajectory of the illicit substance or object introduced via the access opening into the container of the protected material. The terms 'traps' and 'trapping' are particularly used for referring to catching and confining the illicit substance or object, introduced via the access opening into the container of the protected material, in the trap of the present invention.

It is to be fully understood that, unless specifically stated otherwise, the phrase 'operatively connected' is generally used herein, and equivalently refers to the corresponding synonymous phrases 'operatively joined', and 'operatively attached', where the operative connection, operative joint, or operative attachment, is according to a physical, or/and electrical, or/and electronic, or/and mechanical, or/and electromechanical, manner or nature, involving various types and kinds of hardware or/and software equipment and components. Additionally, it is to be fully understood that, unless specifically stated otherwise, the terms 'connectable', 'connected', and 'connecting', are generally used herein, and also may refer to the corresponding synonymous terms 'joinable', 'joined', and 'joining', as well as 'attachable', 'attached', and 'attaching'.

Moreover, all technical and scientific words, terms, or/and phrases, introduced, defined, described, or/and exemplified, in the above Background section, are equally or similarly applicable in the illustrative description of the preferred embodiments, examples, and appended claims, of the present invention. Additionally, as used herein, the term 'about' refers to ±10% of the associated value.

Procedures, steps, sub-steps, and, equipment and materials, system and device assemblies, sub-assemblies, mechanisms, structures, components, elements, and configurations, and, peripheral equipment, utilities, accessories, and materials, as well as operation and implementation, of exemplary preferred embodiments, alternative preferred embodiments, specific configurations, and, additional and optional aspects, characteristics, or features, thereof, of protecting a material from contamination by an illicit substance or object, according to the present invention, are better understood with reference to the following illustrative description and accompanying drawings. Throughout the following illustrative description and accompanying drawings, same reference numbers, or/and letters, refer to same system or device assemblies, sub-assemblies, mechanisms, structures, components, elements, and configurations, and, peripheral equipment, utilities, accessories, and materials.

In the following illustrative description of the present invention, included are main or principal procedures, steps, and sub-steps, and, main or principal system and device assemblies, sub-assemblies, mechanisms, structures, components, elements, and configurations, and, peripheral equipment, utilities, accessories, and materials, needed for sufficiently understanding proper 'enabling' utilization and implementation of the disclosed invention. Accordingly, description of various possible preliminary, intermediate, minor, or/and optional, procedures, steps, or/and sub-steps, or/and, system and device assemblies, sub-assemblies, mechanisms, structures, components, elements, and configurations, and, peripheral equipment, utilities, accessories, and materials, of secondary importance with respect to enabling implementation of the invention, which are readily known by one of ordinary skill in the art, or/and which are available in the prior art and technical literature relating to the field of the present invention, are at most only briefly indicated herein.

Thus, according to a first main aspect of the present invention, there is provision of a method for protecting a material from contamination by an illicit substance or object, the method including the following main steps and components thereof: (a) providing the material inside a closed container having an access opening, (b) aligning a trap with the access opening, (c) mounting the aligned trap within the container, and (d) adding an amount of decoy material to the trap, such that the trap with the decoy material intercepts and traps the illicit substance or object introduced via the access opening into the container, thereby preventing the illicit substance or object from coming into contact with the protected material inside the container.

According to a second main aspect of the present invention, there is provision of a corresponding system for protecting a material from contamination by an illicit substance or object, the system including the following main components and functionalities thereof: (a) a closed container having an access opening, for containing the material, and (b) a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

According to a third main aspect of the present invention, there is provision of a corresponding device for protecting a material within a closed container having an access opening, from contamination by an illicit substance or object introduced into the container, the device including the following main components and functionalities thereof: a trap alignable with the access opening and mountable within the container, and suitable for holding an amount of decoy material, such that when the trap is aligned with the access opening and mounted within the container, and holding the decoy material, the trap intercepts and traps the illicit substance or object introduced via the access opening into the container, thereby preventing the illicit substance or object from coming into contact with the protected material inside the container.

Referring now to the drawings, FIG. 1 is a schematic diagram illustrating a cut away perspective view of the fully operative state of an exemplary preferred embodiment of the corresponding system, hereinafter, referred to as system 10, of the present invention, used for implementing the method of the present invention, for protecting a material from contamination by an illicit substance or object. System 10 is for protecting a material 12, herein, also referred to as protected material 12, from contamination by an illicit substance or object 14 (represented in FIG. 1 by the small black dots being dispersed into the upper portion of access opening 18 and dispersed throughout decoy material 22 inside trap 20), particularly as a result of an unauthorized or illegal act (such as that performed by children, teenagers, or/and animals), which is performed by a perpetrator (indicated in FIG. 1 by the exemplary forms of a teenager throwing an illicit substance or object 14 into access opening 18, a child holding and potentially throwing sticks into access opening 18, and a pair of birds potentially entering or/and releasing excrement into access opening 18, situated either in the immediate vicinity of, or on, access opening 18).

System 10 of the present invention includes the following main components and functionalities thereof: (a) a closed container 16 having an access opening 18, for containing material 12, and (b) a trap 20 alignable with access opening 18 and mountable within container 16, and suitable for holding an amount of decoy material 22, such that when trap 20 is aligned with access opening 18 and mounted within container 16, and holding decoy material 22, trap 20 intercepts and traps illicit substance or object 14 introduced via access opening 18 into container 16, thereby preventing illicit substance or object 14 from coming into contact with protected material 12 inside container 16.

Accordingly, the corresponding device for protecting material within a closed container having an access opening, from contamination by an illicit substance or object introduced into the container, of the present invention, includes the following main components and functionalities thereof: trap 20 alignable with access opening 18 and mountable within container 16, and suitable for holding an amount of decoy material 22, such that when trap 20 is aligned with access opening 18 and mounted within container 16, and holding decoy material 22, trap 20 intercepts and traps illicit substance or object 14 introduced via access opening 18 into container 16, thereby preventing illicit substance or object 14 from coming into contact with protected material 12 inside container 16.

It is to be noted and fully understood, that in a non-limiting manner, the main steps, and sub-steps thereof, of the preferred embodiment of the method of the present invention, Step (a) of providing material 12 inside container 16 having access opening 18, Step (b) of aligning trap 20 with access opening 18 of container 16, Step (c) of mounting aligned trap 20 within container 16, and Step (d) of adding an amount of decoy material 22 to the aligned and mounted trap 20, can be performed according to a wide variety of ways and sequences different from that illustratively described herein below.

In Step (a) of the method for protecting a material from contamination by an illicit substance or object, of the present invention, there is providing the material inside a closed container having an access opening.

With reference to the exemplary preferred embodiment of the system, system 10, of the present invention, illustrated in FIG. 1, material 12 is provided inside closed internally accessible container 16, generally and equivalently referred to as closed container 16, and for brevity, as container 16, having at least one access opening, for example, access opening 18, and is therefore contained and stored in container 16.

In general, material 12 contained and stored in container 16 is any type and quantity (mass, volume) of a liquid phase material, a solid phase material, or a combination thereof. Material 12 is not limited to exhibiting any particular set of physical, chemical, or/and biological properties, characteristics, and behavior (activity), and is not limited to being of a particular quantity of mass or volume. Just a few exemplary specific types of material 12 appropriate for protection by implementing the present invention are water, a petroleum based liquid fuel, such as gasoline or diesel, a raw or intermediate material for manufacturing or processing a finished product, such as a human edible food product, a pharmaceutical product, or a chemical product, and a finished product obtained from completion of a manufacturing process. Typically, the volume of material 12 contained and stored in container 16 is relatively large, for example, of at least several hundreds of liters, and up to several millions of liters.

Container 16 is a tank, reservoir, receptacle, or similar type of closed storage entity whose inside is potentially accessible to humans or/and animals, which is of appropriate size and materials of construction, and is currently used for containing and storing or is intended for containing and storing a large volume, for example, of at least several hundreds of liters, and up to several millions of liters, of essentially any type of liquid or/and solid phase material 12.

In general, container 16 is of any type, and of any geometrical shape or configuration and dimensions (width, length, height or depth, diameter, perimeter), having at least one access opening 18 for providing authorized personnel with access to the inside of container 16, which is appropriate for containing and storing material 12. Container 16 is enclosed on all sides, typically including a cover 24 for enclosing the top side of container 16. Cover 24 may be a non-removable permanent type of cover, or alternatively, may be a removable type of cover, either partly or entirely removable from container 16, for variably covering, closing, and opening, container 16, according to specific need or/and application. For container 16 having a removable type of cover, as an additional security measure, preferably, the cover is lockable to the upper or top portion of container 16 by any of a variety of different types of locking mechanisms known in the art. Preferably, construction of cover 16 includes the at least one access opening 18.

Materials of construction, and construction, of container 16 are not limited to exhibiting any particular set of physical, chemical, or/and biological properties, characteristics, and behavior (activity), and are not limited to having any particular geometrical shape or configuration and dimensions, so long as container 16 has the at least one access opening 18. A few specific examples of materials of construction of container 16 are metal, cement, plastic, rubber, glass, composite material, and combinations thereof. A few specific examples of geometrical shape or configuration of container 16 are cylindrical (as illustrated in FIG. 1), elliptical, and polygonal (for example, square, rectangular, hexagonal). Typically, the effective volumetric capacity, according to the dimensions, of container 16 for containing and storing material 12 is relatively large, for example, of at least several hundreds of liters, and up to several millions of liters.

Preferably, the physical, chemical, or/and biological properties, characteristics, and behavior (activity), and geometrical configuration or form and dimensions, of the materials of construction, and of the construction, of container 16, especially with respect to the inner surface of container 16 directly in contact with or exposed to material 12, are compatible with (i.e., are not affected by, and do not affect) the physical, chemical, or/and biological properties, characteristics, and behavior (activity), and quantity (mass, volume) of material 12.

As illustrated in FIG. 1, container 16 corresponds to a tank or reservoir constructed for containing and storing a relatively large volumetric capacity, according to actual dimensions of container 16, of up to several millions of liters, of residential drinking water or/and industrial water. Typically, a first ladder 26 located on the outer side of container 16, and a second ladder 28 located inside of container 16, along with access opening 18, are used by authorized personnel for entering and providing maintenance (cleaning, repairing) to the inside of container 16.

In general, access opening 18 is of any appropriate type, and of any appropriate geometrical shape or configuration and dimensions (width, length, height, diameter, perimeter), which are compatible with the type and geometrical shape or configuration and dimensions, of the top side enclosure, that is, cover 24, of container 16. In the particular example illustrated in FIG. 1, access opening 18 of container 16 is typically used by authorized personnel for entering and providing maintenance (cleaning, repairing) to the inside of container 16; for adding material 12, or/and other material, from an outside source to container 16; for removing material 12, or/and other material, from container 16 to an outside receiver; for ventilating container 16; for determining the level of material 12 inside container 16; for removing a sample of material 12 from container 16, for the purpose of testing or/and monitoring the quality of material 12, for example, in terms of pre-determined parameters of physical, chemical, or/and biological, properties, characteristics, and behavior (activity), of material 12; or for any combination of such authorized actions or activities.

Figure 2A:
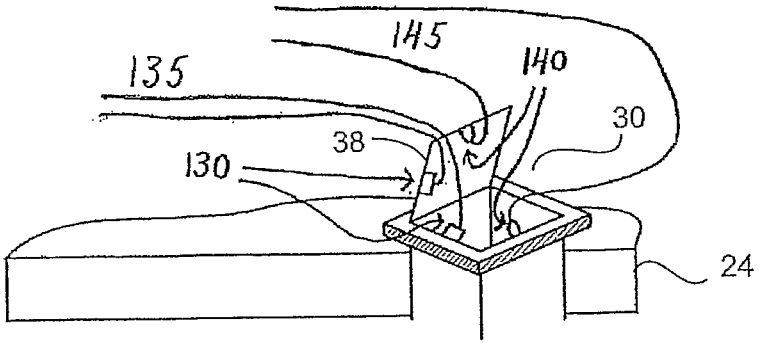
FIG. 2A is a schematic diagram illustrating a cut away side view of a first exemplary type of an access opening, typically configured as part of the construction of the cover of a closed container containing and storing material, used by authorized personnel for entering and providing maintenance (cleaning, repairing) to the inside of the container, wherein are also shown an optional (access opening—cover) opened/closed configuration type of sensor assembly, and an optional (access opening—cover) locking/unlocking assembly, in accordance with the present invention.
Figure 2B:
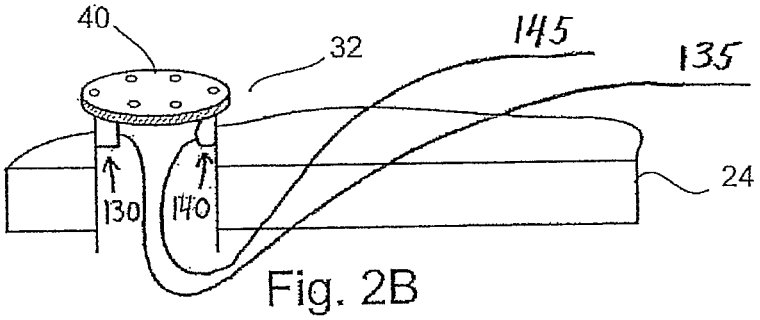
FIG. 2B is a schematic diagram illustrating a cut away side view of a second exemplary type of an access opening, typically configured as part of the construction of the cover of a closed container containing and storing material, used by authorized personnel for adding material from an outside source to the container, or/and for removing material from the container to an outside receiver, wherein are also shown an optional (access opening—cover) opened/closed configuration type of sensor assembly, and an optional (access opening—cover) locking/unlocking assembly, in accordance with the present invention.
Figure 2C:
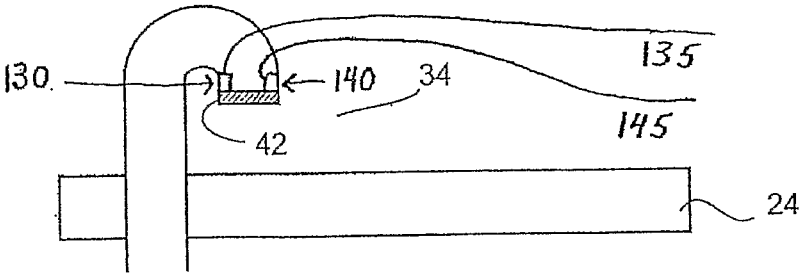
FIG. 2C is a schematic diagram illustrating a cut away side view of a third exemplary type of an access opening, typically configured as part of the construction of the cover of a closed container containing and storing material, used by authorized personnel for ventilating the container, wherein are also shown an optional (access opening—cover) opened/closed configuration type of sensor assembly, and an optional (access opening—cover) locking/unlocking assembly, in accordance with the present invention.
Figure 2D:
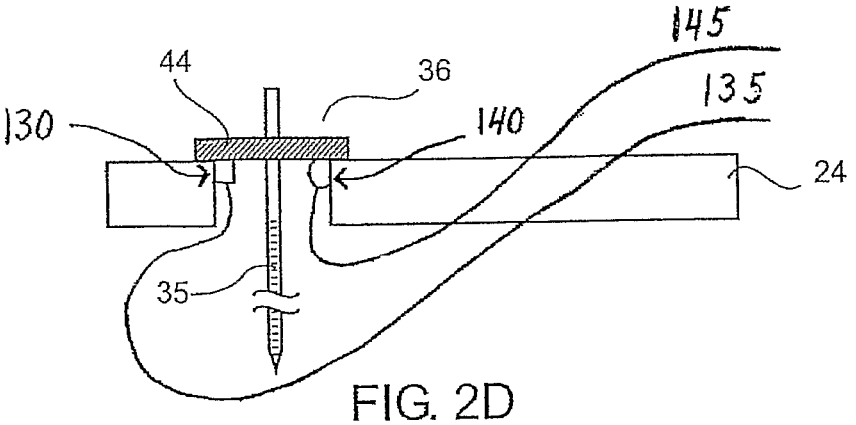
FIG. 2D is a schematic diagram illustrating a cut away side view of a fourth exemplary type of an access opening, typically configured as part of the construction of the cover of a closed container containing and storing material, used by authorized personnel for determining the level of the material inside the container, wherein are also shown an optional (access opening—cover) opened/closed configuration type of sensor assembly, and an optional (access opening—cover) locking/unlocking assembly, in accordance with the present invention.

FIGS. 2A-2D are schematic diagrams each illustrating a cut away side view of a different exemplary type of an access opening, typically configured as part of the construction of cover 24 of closed container 16 containing and storing material 12. Access opening 30 illustrated in FIG. 2A is an exemplary general type of access opening which is generally usable by authorized personnel for performing any of the authorized actions or activities, singly or in combination, that were just stated with respect to access opening 18 of container 16, illustrated in FIG. 1. Access opening 32 illustrated in FIG. 2B is an exemplary specific type of access opening which is specifically usable by authorized personnel for adding material 12, or/and other material, from an outside source to container 16, or/and for removing material 12, or/and other material, from container 16 to an outside receiver. Access opening 34 illustrated in FIG. 2C is another exemplary specific type of access opening which is specifically usable for ventilating container 16. Access opening 36 illustrated in FIG. 2D is another exemplary specific type of access opening which is specifically usable by authorized personnel for determining the level of material 12, for example, including use of a material height or level measuring rod 35, inside container 16.

Materials of construction, and construction, of a given access opening, such as access opening 18 illustrated in FIG. 1, or of each access opening 30, 32, 34, and 36, illustrated in FIGS. 2A-2D, respectively, are not limited to exhibiting any particular set of physical, chemical, or/and biological properties, characteristics, and behavior (activity), and are not limited to having any particular geometrical shape or configuration and dimensions. A few specific examples of materials of construction of a given access opening are metal, cement, plastic, rubber, glass, composite material, and combinations thereof. A few specific examples of geometrical shape or configuration of a given access opening are cylindrical, elliptical, and polygonal (for example, square, rectangular, hexagonal). For example, as illustrated in FIG. 1, access opening 18 is of a square geometrical shape or configuration.

Ordinarily, such as illustrated in FIGS. 1 and 2A-2D, dimensions of a given access opening are significantly proportionately smaller than dimensions of cover 24 of container 16. Ordinarily, vertical length or height of a given access opening extends above cover 24 of container 16, or/and, below cover 24 and into container 16, such as illustrated in FIGS. 1 and 2A-2D, but, may correspond to the thickness of cover 24 of container 16. Moreover, ordinarily, such as illustrated in FIGS. 1 and 2A-2D, diameter or width of a given access opening 18, 30, 32, 34, and 36, respectively, is proportionately smaller than diameter or width of cover 24.

Ordinarily, a given access opening, such as access opening 18 illustrated in FIG. 1, or each access opening 30, 32, 34, and 36, illustrated in FIGS. 2A-2D, respectively, is operatively connected to appropriately designed and constructed closure or covering components and means, for example, a closure or covering element, such as cover 19, as illustrated in FIG. 1, and covers 38, 40, 42, and 44, respectively, as illustrated in FIGS. 2A-2D, respectively, for partially or entirely closing or covering, and for re-opening, the access opening, according to specific need or/and application.

Preferably, the physical, chemical, or/and biological properties, characteristics, and behavior (activity), and geometrical configuration or form and dimensions, of the materials of construction, and of the construction, of a given access opening, especially with respect to the inner surface of the access opening which may be directly in contact with or exposed to material 12, are compatible with (i.e., are not affected by, and do not affect) the physical, chemical, or/and biological properties, characteristics, and behavior (activity), and quantity (mass, volume) of material 12.

In Step (b), there is aligning a trap with the access opening of the container.

Figure 3:
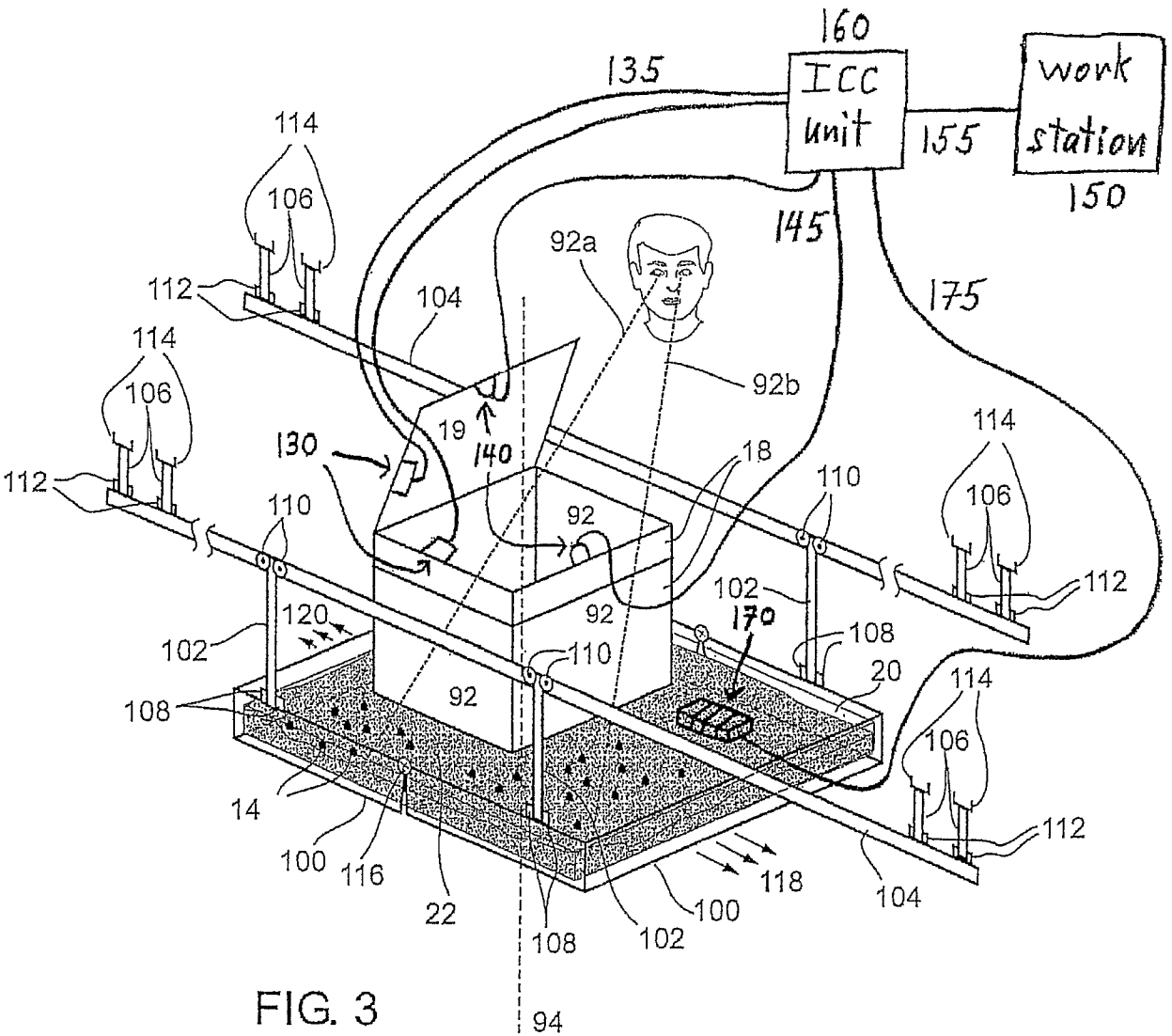
FIG. 3 is a schematic diagram illustrating a close-up perspective view of the aligned and mounted exemplary preferred embodiment of the trap illustrated in FIG. 1, relative to the access opening in the cover of the container containing the protected material, as part of the method and corresponding system for protecting a material from contamination by an illicit substance or object, in accordance with the present invention.
Figure 4:
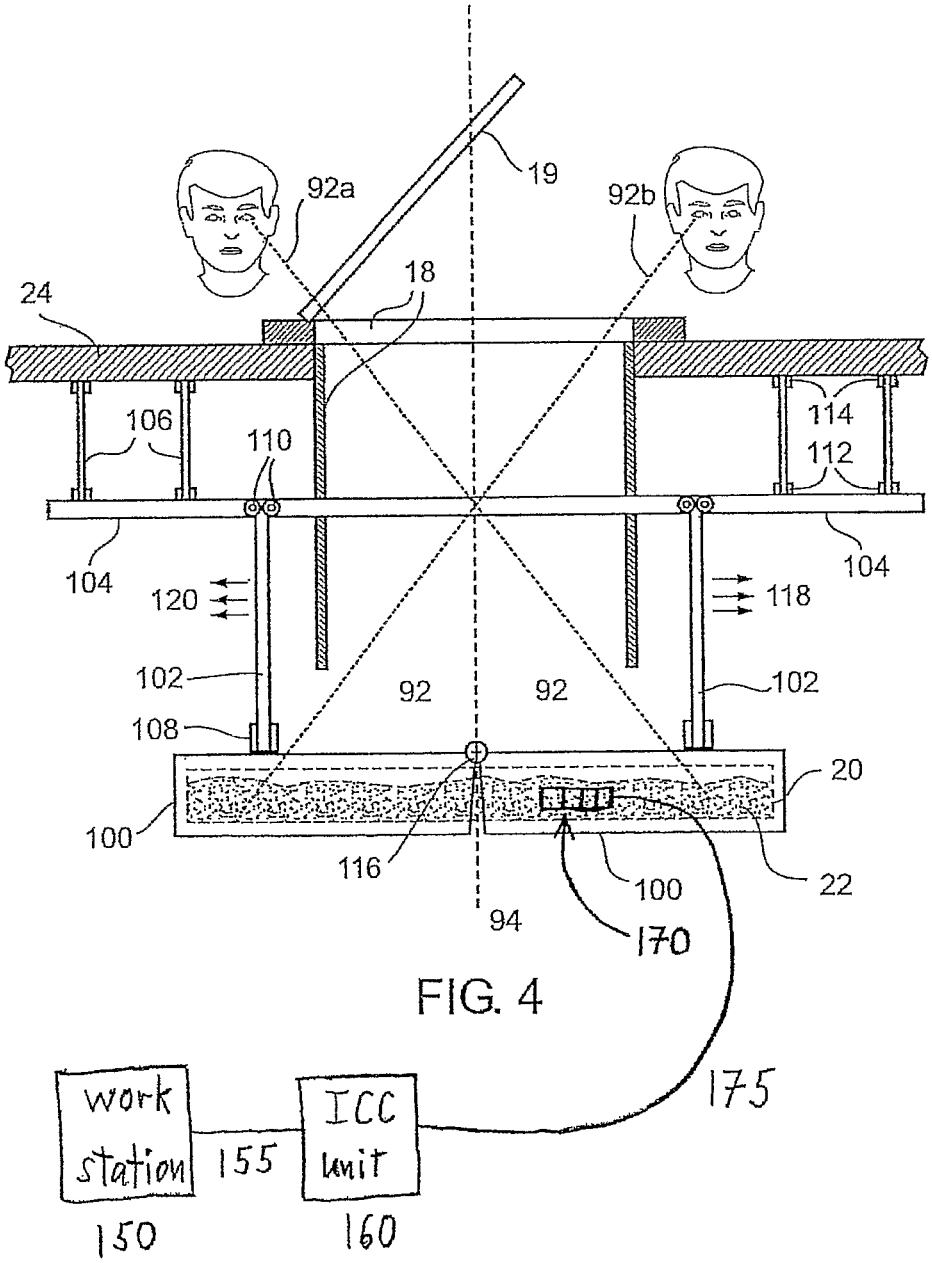
FIG. 4 is a schematic diagram illustrating a close-up cut away side view of the aligned and mounted exemplary preferred embodiment of the trap illustrated in FIGS. 1 and 3, relative to the access opening in the cover of the container containing the protected material, as part of the method and corresponding system for protecting a material from contamination by an illicit substance or object, in accordance with the present invention.

Additional reference is now made to FIGS. 3 and 4, schematic diagrams illustrating a close-up perspective view, and a close-up cut away side view, respectively, of the aligned and mounted exemplary preferred embodiment of trap 20 including an amount of decoy material 22, relative to access opening 18 in cover 24 of container 16 containing protected material 12, as also illustrated in FIG. 1.

In Step (b), trap 20 is aligned with access opening 18 of container 16. Following mounting of trap 20, and adding an amount of decoy material 22 to trap 20, in accordance with Steps (c) and (d), respectively, described herein below, then trap 20 with decoy material 22 intercepts and traps illicit substance or object 14 introduced via access opening 18 into container 16, thereby preventing illicit substance or object 14 from coming into contact with protected material 12 inside container 16.

In general, trap 20 is of any type, and of any geometrical shape or configuration and dimensions (width, length, height, diameter, perimeter), which are appropriate for being aligned with access opening 18 of container 16, for being mounted within container 16, and, for including and holding an amount of decoy material 22, such that trap 20 is operable for intercepting and trapping illicit substance or object 14 introduced via access opening 18 into container 16, thereby preventing illicit substance or object 14 from coming into contact with protected material 12 inside container 16. An exemplary specific preferred embodiment of a type of trap 20 suitable for implementing the present invention is in the form of a tray or a tray-like structure, as illustrated in FIGS. 1, 3, and 4.

Materials of construction, and construction, of trap 20 are not limited to exhibiting any particular set of physical, chemical, or/and biological properties, characteristics, and behavior (activity), and are not limited to having any particular geometrical shape or configuration and dimensions, so long as trap 20 is alignable with access opening 18 of container 16, is mountable within container 16, and is suitable for holding an amount of decoy material 22. A few specific examples of materials of construction of trap 20, in the form of a tray or a tray-like structure, are plastic, rubber, metal, cement, glass, composite material, and combinations thereof. Preferably, the tray or a tray-like structure of trap 20 is made of a material which is relatively chemically inert or resistant, such as a polymeric or plastic material, for example, a polypropylene material, a polyethylene material, a polycarbonate material, a Teflon material, or any combination thereof. A few specific examples of geometrical shape or configuration of the tray or a tray-like structure of trap 20 are polygonal, for example, square or rectangular (as illustrated in FIGS. 1, 3, and 4), triangular, pentagonal, hexagonal, heptagonal, and octagonal, and, circular, cylindrical, and elliptical.

Preferably, the physical, chemical, or/and biological properties, characteristics, and behavior (activity), and geometrical configuration or faint and dimensions, of the materials of construction, and of the construction, of trap 20, especially with respect to the inner surface of trap 20 directly in contact with or exposed to decoy material 22, are compatible with (i.e., are not affected by, and do not affect) the physical, chemical, or/and biological properties, characteristics, and behavior (activity), and quantity (mass, volume) of decoy material 22.

As illustrated in FIGS. 1, 3, and 4, dimensions (length, width, height or depth, diameter, perimeter) of trap 20, for example, having a tray or tray-like structure, are proportionately larger than, and encompass, dimensions of access opening 18, for enabling appropriate alignment of trap 20 with access opening 18, thereby enabling trap 20 to effectively function for intercepting and trapping illicit substance or object 14 introduced via access opening 18 into container 16. Preferably, magnitude of each of the length and width of trap 20, for example, having a tray or tray-like structure, is in a range of between about 1.2 to about 2.0 times the magnitude of the corresponding length and width of access opening 18. More preferably, magnitude of each of the length and width of trap 20, for example, having a tray or tray-like structure, is about 1.5 times the magnitude of the corresponding length and width of access opening 18.

For example, for a square configured access opening 18, such as that illustrated in FIGS. 1, 3, and 4, whose length and width each has an exemplary magnitude of about 80 cm, preferably, the magnitude of each of the length and width of trap 20, for example, having a tray or tray-like structure, is in the range of between about 96 cm to about 160 cm, and more preferably, the magnitude of each of the length and width of trap 20 is about 120 cm.

As illustrated in FIGS. 1, 3, and 4, dimensions of trap 20 are proportionately smaller than dimensions of container 16, thereby enabling appropriate mounting of trap 20 within container 16. The effective volumetric capacity, for example, of at least several liters, and up to several hundreds of liters, according to the dimensions, of trap 20 for containing an amount of decoy material 22 is significantly relatively smaller than the effective volumetric capacity, for example, of at least several hundreds of liters and up to several millions of liters, of container 16 which contains and stores protected material 12.

Optionally, trap 20 includes a screen attached or connected to, and encompassing the perimeter of, the upper end or top portion of the walls of trap 20. For example, a screen whose openings have a size in a range of between about 1 mm and about 50 mm, preferably, in a range of between about 3 mm and about 20 mm, and more preferably, whose openings have a size of about 8 mm. Materials of construction of such a screen are either the same as, or different from, those of trap 20 described above. The function of such a screen attached or connected to the upper end or top portion of the walls of trap 20 is to assist in the function of trap 20 for intercepting and trapping illicit substance or object 14 introduced via access opening 18 into container 16, thereby preventing illicit substance or object 14 from coming into contact with protected material 12 inside container 16.

In Step (b), aligning trap 20 with access opening 18 of container 16 is performed according to a specifically designed three-dimensional geometrical and dimensional relative configuration, which accounts for the geometrical shape or configuration and dimensions of trap 20 relative to the geometrical shape or configuration and dimensions of access opening 18, in combination with the amount (especially with respect to the visibly exposed surface area) of decoy material 22 added to, and contained by, trap 20, in order to generate a 'protective' type of visual illusion directed against the perpetrator (for example, child, teenager, or animal) of the unauthorized or illegal act introducing illicit substance or object 14 via access opening 18 into container 16. When trap 20 is appropriately aligned with access opening 18 of container 16, followed by being mounted therein, the perpetrator (child, teenager, or animal) of the unauthorized or illegal act introducing illicit substance or object 14 via access opening 18 into container 16 'is able to see' only the exposed portion of decoy material 22 inside trap 20, and 'is not able to see' any part of the mounting components of trap 20, and 'is not able to see' any part of protected material 12 inside container 16. In other words, trap 20 is aligned with access opening 18 in a particular manner such that the maximum possible view or range of sight (represented in FIGS. 1, 3, and 4, by the visual volume or space 92 encompassed by, and included in between, dashed lines 92*a* and 92*b*) of the perpetrator of the unauthorized or illegal act, before, during, and after, the time of committing the unauthorized or illegal act, is limited to that of only the exposed portion of decoy material 22 inside trap 20, whereby all of the mounting components of trap 20, and all of protected material 12 inside container 16, are entirely outside of this view or range of sight of perpetrator (child, teenager, or animal).

Accordingly, while the unauthorized or illegal act is taking place, during the time the perpetrator introduces illicit substance or object 14 via access opening 18 into container 16, operation of the present invention includes generation of a 'protective' type of visual illusion. The perpetrator is unknowingly provided with a visual illusion and thinks that by his introducing illicit substance or object 14 into container 16, illicit substance or object 14 will come into direct contact with protected material 12 inside container 16, where in reality, by operation of the present invention, trap 20 with decoy material 22 intercepts and traps illicit substance or object 14 introduced into container 16, and prevents illicit substance or object 14 from coming into contact with protected material 12 inside container 16, without the perpetrator being aware of this.

Preferably, geometrical shape or configuration and dimensions of trap 20, for example, having a tray or tray-like structure, relative to geometrical shape or configuration and dimensions of access opening 18, in addition to the amount (especially with respect to the visibly exposed surface area) of decoy material 22 added to and contained in trap 20, are selected and used for enabling such a particular type of alignment, for assuring proper production of the above described visual illusion, and therefore, for assuring proper operation of the invention. For example, as shown in FIGS. 1, 3, and 4, preferably, trap 20, having a tray or tray-like structure, is co-axially aligned with access opening 18 of container 16, whereby the central longitudinal axis of square or rectangular shaped trap 20 is aligned and coincident with the central longitudinal axis of access opening 18, such that trap 20 and access opening 18 have the same central longitudinal axis 94. For example, also as shown in FIGS. 1, 3, and 4, preferably, the opening of trap 20 oriented towards and facing the underside of cover 24 of container 16 is aligned with the bottom portion of access opening 18 oriented towards and facing towards the bottom of the inside of container 16. For example, also as shown in FIGS. 1, 3, and 4, preferably, the amount of decoy material 22 added to and contained in trap 20 occupies a volume of trap 20 which at least covers the entire bottom and at least part of the side walls inside of trap 20.

Additionally, the lower end or bottom portion of access opening 18 facing towards the top exposed portion of decoy material 22 is either in direct contact with decoy material 22, or, preferably, is separated from, and above, decoy material 22, at a separation distance of at least a few centimeters. As long as when trap 20 is so aligned with access opening 18 of container 16, followed by being mounted therein, the perpetrator of the unauthorized or illegal act introducing illicit substance or object 14 via access opening 18 into container 16 is able to see only the contents, that is, decoy material 22, inside trap 20, and is not able to see any part of the mounting components of trap 20, and is not able to see any part of protected material 12 inside container 16.

In Step (c), there is mounting the aligned trap within the container.

In general, mounting aligned trap 20 within container 16, preferably, to the underside of cover 24 facing inside container 16, is performed by using any of a variety of different mounting methods and techniques, and by using any of a variety of different mounting equipment, devices, mechanisms, components, elements, and materials, herein, generally referred to in the description and in the accompanying drawings as trap mounting means, known in the art of mounting similar types of structures.

Referring again to FIGS. 1, 3, and 4, an exemplary trap mounting means for mounting aligned trap 20 within container 16 includes the main components: (i) a trap holder 100, (ii) a first set of trap holder support elements 102, (iii) a second set of trap holder support elements 104, and (iv) a third set of trap holder support elements 106. The exemplary mounting means of trap 20 additionally includes the components: (v) a first set of connectors 108, (vi) a second set of connectors 110, (vii) a third set of connectors 112, and a fourth set of connectors 114.

Trap holder 100, as part of trap mounting means 100-114, is for holding trap 20. In general, trap holder 100 is of any type, and of any geometrical shape or configuration and dimensions (width, length, height, diameter, perimeter), which are appropriate for holding and mounting trap 20, and for enabling trap 20 to be aligned with access opening 18 according to previous Step (b), within container 16, wherein trap 20 includes and holds an amount of decoy material 22, such that trap 20 is operable for intercepting and trapping illicit substance or object 14 introduced via access opening 18 into container 16, thereby preventing illicit substance or object 14 from coming into contact with protected material 12 inside container 16. An exemplary specific preferred embodiment of a type of trap holder 100 suitable for implementing the present invention is in the form of a tray or a tray-like structure which encompasses the exemplary tray or a tray-like structure of trap 20, as illustrated in FIGS. 1, 3, and 4.

Materials of construction, and construction, of trap holder 100 are not limited to exhibiting any particular set of physical, chemical, or/and biological properties, characteristics, and behavior (activity), and are not limited to having any particular geometrical shape or configuration and dimensions, so long as trap 20 is alignable with access opening 18 of container 16, is mountable within container 16, and is able to include and hold an amount of decoy material 22. A few specific examples of materials of construction of trap holder 100, in the form of a tray or a tray-like structure, are plastic, rubber, metal, cement, glass, composite material, and combinations thereof. Preferably, the tray or a tray-like structure of trap holder 100 is made of a plastic material, such as a polypropylene material, a polyethylene material, a polycarbonate material, a Teflon material, or any combination thereof. A few specific examples of geometrical shape or configuration of the tray or a tray-like structure of trap holder 100 are polygonal, for example, square or rectangular (as illustrated in FIGS. 1, 3, and 4), triangular, pentagonal, hexagonal, heptagonal, and octagonal, and, circular, cylindrical, and elliptical.

As illustrated in FIGS. 1, 3, and 4, dimensions (length, width, height or depth, diameter, perimeter) of trap holder 100, for example, having a tray or tray-like structure, are only slightly larger than, and encompass, dimensions of trap 20, and enable appropriate alignment of trap 20 with access opening 18, thereby enabling trap 20 to effectively function for intercepting and trapping illicit substance or object 14 introduced via access opening 18 into container 16. Preferably, magnitude of each of the length and width of trap holder 100, for example, having a tray or tray-like structure, is in a range of between about 1.01 to about 1.5 times the magnitude of the corresponding length and width of trap 20. More preferably, magnitude of each of the length and width of trap holder 100, for example, having a tray or tray-like structure, is about 1.1 times the magnitude of the corresponding length and width of trap 20.

For example, for a square configured access opening 18 whose length and width each has an exemplary magnitude of about 80 cm, and for a square configured tray or tray-like structure of trap 20 whose length and width each has an exemplary magnitude of about 120 cm, preferably, the magnitude of each of the length and width of trap holder 100, for example, having a tray or tray-like structure, is in the range of between about 121 cm to about 180 cm, and more preferably, the magnitude of each of the length and width of trap 20 is about 135 cm.

Optionally, and preferably, trap holder 100, for example, having a tray or tray-like structure, is foldable, via a folding joint 116, for example, into two parts, preferably, halves, as illustrated in FIGS. 1, 3, and 4, when trap 20 is not being held by trap holder 100. Such is needed, for example, for the case when authorized personnel install, remove, or service, trap holder 100, or/and trap 20.

Trap holder 100 is supported and operatively connectable to the underside of cover 24 facing inside container 16 as follows. Selected upper or top end portions of trap holder 100 are operatively connectable, via first set of connectors 108, to first set of trap holder support elements 102. First set of trap holder support elements 102 is operatively connectable, via second set of connectors 110, to selected portions of second set of trap holder support elements 104. Second set of trap holder support elements 104 is operatively connectable, via third set of connectors 112, to the lower or bottom end portions of third set of trap holder support elements 106. Third set of trap holder support elements 106, is operatively connectable, via fourth set of connectors 114, to selected portions of the underside of cover 24 facing inside container 16.

In general, mounting means support elements and connectors 102-114 are of any type, and of any geometrical shape or configuration and dimensions, which are appropriate for enabling the mounting of trap 20, as aligned with access opening 18 according to previous Step (b), and held by trap holder 100 within container 16, and for enabling trap 20 to include and hold an amount of decoy material 22, such that trap 20 is operable for intercepting and trapping illicit substance or object 14 introduced via access opening 18 into container 16, thereby preventing illicit substance or object 14 from coming into contact with protected material 12 inside container 16.

Materials of construction, and construction, of mounting means support elements and connectors 102-114 are not limited to exhibiting any particular set of physical, chemical, or/and biological properties, characteristics, and behavior (activity), and are not limited to having any particular geometrical shape or configuration and dimensions, so long as trap 20, aligned with access opening 18, is mountable within container 16, and is able to include and hold an amount of decoy material 22. For example, mounting means support elements and connectors 102-114, used for mounting trap 20 within container 16, may either be, or/and may include, one or more fixed, non-movable or/and non-fixed, movable, types of holders, support elements, beams, brackets, bars, tracks, channels, posts, nails, screws, nuts, bolts, pins, clips, clamps, connectors, joiners, adhesives, glue, cement, epoxy, tape, wires, cord, and combinations thereof, or/and similar types of assemblies, components, elements, and materials known in the art which are applicable for mounting, connecting, joining, or attaching, structures to each other.

In Step (c), trap 20, in a non-limiting manner, for example, having a tray or tray-like structure, having been aligned with access opening 18 according to previous Step (b), is mounted within container 16 according to a 'fixed, non-movable' mounting configuration relative to access opening 18, herein, generally referred to as a non-movable mounting configuration, using fixed, non-movable mounting means, for example, wherein trap mounting means 100-114 are fixed or non-movable relative to access opening 18. Alternatively, trap 20, for example, having a tray or tray-like structure, having been aligned with access opening 18 according to previous Step (b), is mounted within container 16 according to a 'non-fixed, movable' mounting configuration relative to access opening 18, herein, generally referred to as a movable mounting configuration, using non-fixed, movable mounting means, for example, wherein trap mounting means 100-114 are non-fixed or movable relative to access opening 18. Accordingly, the type, composition, construction, and arrangement, of the mechanism(s), assembly(ies), components, elements, and materials, of the trap mounting means 100-114 are such that trap 20, following alignment with access opening 18 of container 16, is mounted within container 16 according to either a non-movable mounting configuration or a movable mounting configuration relative to access opening 18.

When system 10 is in 'active' operation for actively protecting material 12, the aligned and mounted trap 20 and decoy material 22 therein, as well as trap mounting means 100-114, remain in a constant position relative to access opening 18 within container 16, regardless of whether trap 20 is mounted according to a non-movable mounting configuration or according to a movable mounting configuration. When system 10 is not in 'active' operation for actively protecting material 12, system 10 can be readily subjected to maintenance or/and service by authorized personnel. Exemplary primary maintenance or/and service activities are inspecting, repairing, or/and replacing, trap 20 or/and trap mounting means 100-114, as well as inspecting, adding, removing, or replacing, decoy material 22 inside of trap 20. Such maintenance or/and service activities are performed by the authorized personnel in an appropriate manner according to whether trap 20 is mounted in the non-movable mounting configuration or in the movable mounting configuration.

For the particular embodiment of system 10 wherein trap 20 is mounted according to the non-movable mounting configuration, wherein trap mounting means 100-114 are fixed or non-movable relative to access opening 18 within container 16, there is providing maintenance or service to trap 20 or/and decoy material 22 therein, or/and to trap mounting means 100-114, 'as is', that is, in the same (three dimensional) spatial position and configuration that trap 20 was initially aligned relative to access opening 18 and mounted within container 16.

For the particular embodiment of system 10 wherein trap 20 is mounted according to the movable mounting configuration, wherein trap mounting means 100-114 are non-fixed or movable relative to access opening 18 within container 16, there is providing maintenance or service to trap 20 or/and decoy material 22 therein, or/and to trap mounting means 100-114, by using the movable trap mounting means 100-114 for (right or left) laterally or horizontally moving or sliding trap holder 100, and therefore, trap 20, to a (right or left) lateral or horizontal position different from which trap 20 was initially aligned relative to access opening 18 and mounted within container 16. This right or left lateral or horizontal moving or sliding of trap holder 100, and therefore, of trap 20, to a right or left lateral or horizontal position, respectively, different from which trap 20 was initially aligned relative to access opening 18 and mounted within container 16, is indicated in FIGS. 3 and 4 by the set of right directed arrows 118 and by the set of left directed arrows 120, respectively.

In such an exemplary movable trap mounting configuration, for enabling the just described right (118) or left (120) lateral or horizontal moving or sliding of trap holder 100, and therefore, of trap 20, second set of trap holder support elements 104 is in the form of supportive guiding structures, for example, tracks or channels, within which second set of connectors 110 is in the form of movable connectors, for example, wheels, bearings, or rollers. Preferably, in such an exemplary movable trap mounting configuration, second set of trap holder support elements 104 and third set of trap holder support elements 106 are in fixed, non-movable positions or configurations, at selected portions of the underside of cover 24 facing inside container 16, relative to access opening 18.

Preferably, mounting of aligned trap 20 within container 16, via trap mounting means 100-114, regardless of whether trap 20 is mounted according to a non-movable mounting configuration or according to a movable mounting configuration, is readily reversible by an authorized person, such that trap 20 or/and decoy material 22 therein, or/and trap mounting means 100-114, are unmountable, and if needed, removable, from within container 16, according to specific need or/and application. For example, for authorized personnel to inspect, repair, or/and replace, trap 20, or/and trap mounting means 100-114, or/and to inspect, add, remove, or replace, decoy material 22 inside of trap 20.

In Step (d), there is adding an amount of decoy material to the trap.

Referring again to FIGS. 1, 3, and 4, in general, adding an amount of decoy material 22 to trap 20 is performed by using any of a variety of different types of automatic, semi-automatic, or/and manual, methods and techniques, and by using any of a variety of different types of automatically, semi-automatically, or/and manually, operated equipment, devices, mechanisms, components, elements, and materials, herein, for brevity, generally referred to as decoy material adding means, known in the art of adding a material to a container having the same or similar configuration and dimensions as trap 20.

The amount (especially with respect to the visibly exposed surface area) of decoy material 22 added to and contained in trap 20, in combination with the specifically designed three-dimensional geometrical and dimensional relative configuration which accounts for the geometrical shape or configuration and dimensions of trap 20 relative to the geometrical shape or configuration and dimensions of access opening 18, is of sufficient quantity such that there is generating the above previously illustratively described 'protective' type of visual illusion directed against the perpetrator (child, teenager, or animal) of the unauthorized or illegal act introducing illicit substance or object 14 via access opening 18 into container 16. For example, also as shown in FIGS. 1, 3, and 4, preferably, the amount of decoy material 22 added to and contained in trap 20 occupies a volume of trap 20 which at least covers the entire bottom and at least part of the side walls inside of trap 20.

In general, decoy material 22 is essentially any type of liquid or/and solid phase material which is the same as, or different from, protected material 12 that is currently contained and stored, or that is intended to be contained and stored, in container 16. Accordingly, decoy material 22 is, for example, water, a petroleum based liquid fuel, such as gasoline, diesel fuel, or airplane fuel, a raw or intermediate material used for processing or manufacturing a finished product, such as a human edible food product, a pharmaceutical product, or a chemical product, and a finished product obtained from completion of a manufacturing process. Preferably, decoy material 22 is the same as protected material 12 that is currently contained and stored, or that is intended to be contained and stored, in container 16, in order to maximize generation of the above previously illustratively described protective type of visual illusion directed against the perpetrator of the unauthorized or illegal act introducing illicit substance or object 14 via access opening 18 into container 16. Accordingly, the perpetrator, unknowingly provided with the visual illusion, thinks and believes that by his introducing illicit substance or object 14 into container 16, illicit substance or object 14 will come into direct contact with protected material 12 inside container 16, where in reality, by operation of the present invention, trap 20 with decoy material 22 intercepts and traps illicit substance or object 14 introduced into container 16, and prevents illicit substance or object 14 from coming into contact with protected material 12 inside container 16, without the perpetrator being aware of this.

Alternatively, for safety considerations, in particular, in order to avoid or at least minimize the possibility of production of a flammable or explosive mix between decoy material 22 and illicit substance or object 14, following introduction of illicit substance or object 14 via access opening 18 into container 16, decoy material 22 is a material different from protected material 12. Such a different type of material which is usable as decoy material 12 is, for example, sand, earth, or another similar type of material which is generally inert to, or at most, only mildly reactive with, a wide variety of different types of possible illicit substances or objects 14.

As previously stated above, it is to be noted and fully understood, that in a non-limiting manner, the main steps, and sub-steps thereof, of the preferred embodiment of the method of the present invention, Step (a) of providing material 12 inside container 16 having access opening 18, Step (b) of aligning trap 20 with access opening 18 of container 16, Step (c) of mounting aligned trap 20 within container 16, and Step (d) of adding an amount of decoy material 22 to the aligned and mounted trap 20, can be performed according to a variety of ways and sequences different from that illustratively described hereinabove.

For example, in Step (a), providing material 12 inside container 16 having access opening 18 is performed according to any of a variety of different ways and sequences. For example, first, container 16 is covered and closed with cover 24, followed by adding material 12 to closed container 16, via an appropriate type of access opening, for example, access opening 18 or other type of access opening usable for adding a material to a closed container. Alternatively, first, material 12 is added to container 16 being in an opened configuration, that is, with cover 24 either at least partly lifted up or entirely removed from container 16, followed by covering and closing container 16 with cover 24. In general, Step (a) is performed before or/and after alignment of trap 20 with access opening 18, or/and, before or/and after mounting of trap 20 within container 16.

For example, Step (b), of aligning trap 20 with access opening 18 of container 16 is performed before or/and after Step (c) of mounting aligned trap 20 within container 16, or/and, before or/and after Step (d) of adding an amount of decoy material 22 to trap 20.

For example, in Step (d), an amount of decoy material 22 is added to trap 20 before or/and after alignment of trap 20 with access opening 18, or/and, before or/and after mounting of trap 20 within container 16. For example, first, trap 20, void of decoy material 22, is aligned with access opening 18, from within or from without container 16, in accordance with preceding Step (b), followed by mounting aligned trap 20 within container 16, in accordance with preceding Step (c), followed by adding an amount of decoy material 22 from within container 16, or via access opening 18, to aligned and mounted trap 20 within container 16. Alternatively, first, an amount of decoy material 22 is added to trap 20 initially void of decoy material 22, while trap 20 is outside of container 16, followed by aligning trap 20 containing the amount of decoy material 22, with access opening 18, in accordance with preceding Step (b), followed by mounting aligned trap 20 within container 16, in accordance with preceding Step (c).

By performing the hereinabove illustratively described Steps (a) through (d) of the preferred embodiment of the method of the present invention, along with using the hereinabove illustratively described exemplary preferred embodiment of the corresponding system, system 10, including trap 20, of the present invention, as illustrated in FIGS. 1, 3, and 4, then, the present invention is fully operative for protecting material 12 from contamination by illicit substance or object 14, particularly as a result of an unauthorized or illegal act, such as that performed by children, teenagers, as well as that often performed by animals, such as by birds or insects or/and by small land animals, for example, rodents, squirrels, and snakes. In the event of a break in the overall security environment of protected material 12 stored in container 16, particularly as a result of an unauthorized or illegal act, such as that performed by children, teenagers, or/and animals, trap 20 with decoy material 22 therein, intercepts and traps illicit substance or object 14 introduced by the perpetrator (child, teenager, or animal) of the unauthorized or illegal act, via access opening 18, into container 16, thereby preventing illicit substance or object 14 from coming into contact with protected material 12 inside container 16.

Optional, Additional Steps, Components, and Functionalities Thereof

The method for protecting a material from contamination by an illicit substance or object, of the present invention, optionally, includes any number and combination of a variety of optional, additional steps and components thereof. It is to be fully understood, that in a corresponding manner, the corresponding system for protecting a material from contamination by an illicit substance or object, of the present invention, and the corresponding device (i.e., trap) for protecting material within a closed container having an access opening, from contamination by an illicit substance or object introduced into the container, of the present invention, each, optionally, includes any corresponding number and combination of a variety of additional components and functionalities thereof, for additionally protecting the material from contamination by an illicit substance or object. Accordingly, without being unnecessarily repetitive and verbose, it is to be fully understood in the following illustrative description, that components used for performing or implementing optional, additional steps of the method, correspond to optional, additional components and functionalities thereof, of the corresponding system, or/and of the corresponding device (i.e., trap) of the present invention.

Automatic Sensing of an Opened or Closed Configuration of Closure or Covering Components and Means of the Access Opening As previously stated hereinabove, in system 10, ordinarily, a given access opening, such as access opening 18 illustrated in FIGS. 1, 3, and 4, or each access opening 30, 32, 34, and 36, illustrated in FIGS. 2A-2D, respectively, is operatively connected to appropriately designed and constructed closure or covering components and means, for example, a closure or covering element, such as cover 19, as illustrated in FIGS. 1, 3, and 4, and covers 38, 40, 42, and 44, respectively, as illustrated in FIGS. 2A-2D, respectively, for partially or entirely closing or covering, and for re-opening, access opening 18 (FIGS. 1, 3, and 4), or each access opening 30, 32, 34, and 36, respectively (FIGS. 2A-2D, respectively), according to specific need or/and application.

For such embodiments or configurations of system 10, then, the method of the present invention further includes the optional, additional step of automatically sensing an opened or closed configuration, and extent thereof, of the closure or covering components and means of the access opening.

Accordingly, for example, with reference to FIGS. 1-4, the method of the present invention further includes the optional, additional step of automatically sensing an opened or closed configuration, and extent thereof, of the closure or covering components and means, for example, closure or covering element, such as cover 19 of access opening 18 (FIGS. 1, 3, and 4), and covers 38, 40, 42, and 44, of access openings 30, 32, 34, and 36, respectively (FIGS. 2A-2D, respectively).

The optional, additional step of automatically sensing an opened or closed configuration, and extent thereof, of the closure or covering components and means, is performed by using, for example, an opened/closed configuration type of sensing assembly, being operatively connectable to the access opening, or/and operatively connectable to the closure or covering components and means of the access opening. In a corresponding manner, the corresponding system of the present invention, optionally, additionally includes an opened/closed configuration type of sensing assembly, being operatively connectable to the access opening, or/and operatively connectable to the closure or covering components and means of the access opening, for automatically sensing an opened or closed configuration, and extent thereof, of the closure or covering components and means.

Accordingly, for example, with reference to FIGS. 1, 3, and 4, the automatically sensing an opened or closed configuration, and extent thereof, of the closure or covering components and means, for example, closure or covering element, cover 19 of access opening 18 (FIGS. 1, 3, and 4), is performed by using an opened/closed configuration type of sensing assembly, for example, open/close configuration type of sensing assembly 130 (as illustrated in FIGS. 1 and 3), being operatively connectable to access opening 18, or/and operatively connectable to closure or covering components and means, cover 19, of access opening 18.

For alternative embodiments of the method and corresponding system, system 10, including different specific types of an access opening 30, 32, 34, or 36, as illustratively described hereinabove, with reference to FIGS. 2A-2D, respectively, then, the automatically sensing an opened or closed configuration, and extent thereof, of closure or covering components and means, for example, closure or covering element, cover 38, 40, 42, or 44, of access opening 30, 32, 34, or 36, respectively (FIGS. 2A-2D, respectively), is performed by using opened/closed configuration type of sensing assembly 130, being operatively connectable to each respective access opening, or/and operatively connectable to each respective closure or covering components and means of each respective access opening.

In the method and corresponding system, for example, system 10, of the present invention, the open/close configuration sensing assembly, for example, opened/closed configuration type of sensing assembly 130, is operative according to at least one type of automatic sensing mechanism selected from the group consisting of electrical automatic sensing mechanisms, magnetic automatic sensing mechanisms, electromagnetic automatic sensing mechanisms, electro-mechanical automatic sensing mechanisms, optical automatic sensing mechanisms, electro-optical automatic sensing mechanisms, magneto-optical automatic sensing mechanisms, and electronic automatic sensing mechanisms.

The optional, additional step of automatically sensing an opened or closed configuration, and extent thereof, of the closure or covering components and means, for example, closure or covering element, cover 19 of access opening 18 (FIGS. 1, 3, and 4), is performed, preferably, by interfacing and communicating with, and being controlled by, a work station, for example, work station 150, as illustrated in FIGS. 1 and 3. In a corresponding manner, the corresponding system, for example, system 10, of the present invention, optionally, additionally includes a work station, for example, work station 150, for interfacing and communicating with, and controlling, the automatically sensing an opened or closed configuration, and extent thereof, of closure or covering components and means, for example, closure or covering element, cover 19, of access opening 18.

In general, the work station, for example, work station 150, includes any number and kinds or types of human operators, or/and includes any number and kinds or types of fully automatic or/and semi-automatic mechanized type operators. Moreover, the work station includes any number and kinds or types of fixed or/and portable (mobile) computers or/and computerized equipment, and computer software, and includes any number and kinds or types of fixed or/and portable (mobile) communication equipment (e.g., land-line phones or/and mobile or cellular phones, and associated software components thereof), which may be needed for on-site (locally) or/and off-site (distantly) performing the interfacing, communicating, and controlling, of the automatically sensing an opened or closed configuration, and extent thereof, of the closure or covering components and means, of the access opening.

The interfacing, communicating, and controlling, of the automatically sensing an opened or closed configuration, and extent thereof, of the closure or covering components and means, is performed, preferably, by using an interface, communication, and control, unit, being operatively connectable, for example, via at least one interface/communication/control signal line, to the opened/closed configuration type of sensing assembly, and operatively connectable, for example, via at least one interface/communication/control signal line, to the work station. In a corresponding manner, the corresponding system of the present invention, optionally, additionally includes an interface, communication, and control, unit, being operatively connectable, for example, via at least one interface/communication/control signal line, to the opened/closed configuration type of sensing assembly, and operatively connectable, for example, via at least one interface/communication/control signal line, to the work station. The interface, communication, and control, unit, enables the work station to perform the interfacing, communicating, and controlling, of the automatically sensing an opened or closed configuration, and extent thereof, of the closure or covering components and means.

For example, as illustrated in FIGS. 1 and 3, the interfacing, communicating, and controlling, of the automatically sensing an opened or closed configuration, and extent thereof, is performed by using interface, communication, and control, unit (ICC unit) 160, being operatively connectable, for example, via at least one interface/communication/control signal line 135, to opened/closed configuration type of sensing assembly 130, and operatively connectable, for example, via interface/communication/control signal line 155, to work station 150. Operative connection of at least one interface/communication/control signal line 135 to opened/closed configuration type of sensing assembly 130, is also illustrated in FIGS. 2A-2D, for each alternative embodiment of the method and corresponding system, system 10, including a respective different specific type of access opening 30, 32, 34, or 36.

In the method, and corresponding system, of the present invention, the preceding illustratively described interfacing, communicating, and controlling, of the automatically sensing an opened or closed configuration, and extent thereof, of the closure or covering components and means, is effected according to a temporal mode or/and protocol selected from the group consisting of a temporally continuous mode or/and protocol, a temporally discontinuous (i.e., periodic or sporadic) mode or/and protocol, and a combination thereof. According to specific need or/and application of the present invention, the actual continuous, discontinuous, or combination, temporal mode or/and protocol that is used, is either set or established in advance, such as in a pre-determined or scheduled manner, or is instantaneously set or established at a given instant, such as in an instantaneous or 'on-the-fly' manner.

Additionally, in the method, and corresponding system, of the present invention, the preceding illustratively described interfacing, communicating, and controlling, of the automatically sensing an opened or closed configuration, and extent thereof, of the closure or covering components and means, is effected according to a mode or/and protocol selected from the group consisting of a wired mode or/and protocol, a wireless mode or/and protocol, and a combination thereof. According to the particular mode or protocol used for effecting the interfacing, communicating, and controlling, of the automatically sensing an opened or closed configuration, and extent thereof, of the closure or covering components and means, there is using corresponding hardware equipment, peripheral devices, and components, and corresponding software.

Automatic Locking or Unlocking of Closure or Covering Components and Means of The Access Opening Alternatively, or additionally, for such embodiments or configurations of system 10, wherein, ordinarily, a given access opening is operatively connected to closure or covering components and means, for example, a closure or covering element, such as a cover, as illustrated in FIGS. 1-4, for partially or entirely closing or covering, and for re-opening, the access opening, according to specific need or/and application, then, the method of the present invention further includes the optional, additional step of providing locking/unlocking components and means, being operatively connectable to the access opening or/and operatively connectable to the closure or covering components and means of the access opening, for locking or unlocking the closure or covering components and means of the access opening. In a corresponding manner, the corresponding system of the present invention, optionally, additionally includes locking/unlocking components and means, being operatively connectable to the access opening or/and operatively connectable to the closure or covering components and means of the access opening, for locking or unlocking the closure or covering components and means of the access opening.

Accordingly, for example, with reference to FIGS. 1 and 3, the method of the present invention further includes the optional, additional step of providing locking/unlocking components and means, for example, locking/unlocking assembly 140, being operatively connectable to access opening 18, or/and operatively connectable to closure or covering components and means, for example, closure or covering element, such as cover 19, of access opening 18, for locking or unlocking the closure or covering components and means, i.e., locking/unlocking assembly 140.

For alternative embodiments of the method and corresponding system, system 10, including different specific types of an access opening 30, 32, 34, or 36, as illustratively described hereinabove, with reference to FIGS. 2A-2D, respectively, then, there is providing locking/unlocking components and means, for example, locking/unlocking assembly 140, being operatively connectable to access opening 30, 32, 34, or 36, respectively, or/and operatively connectable to closure or covering components and means, for example, closure or covering element, cover 38, 40, 42, or 44, respectively, of access opening 30, 32, 34, or 36, respectively.

In the method and corresponding system, for example, system 10, of the present invention, the locking or unlocking of the locking/unlocking components and means, for example, locking/unlocking assembly 140, of the access opening, is performed according to a manner selected from the group consisting of manually, semi-automatically, fully automatically, and any combination thereof.

In the method and corresponding system, for example, system 10, of the present invention, the locking or unlocking of the locking/unlocking components and means, of the access opening, is performed, preferably, automatically, and the locking/unlocking components and means, for example, locking/unlocking assembly 140, are operative according to at least one type of automatic locking/unlocking mechanism selected from the group consisting of electrical automatic locking/unlocking mechanisms, magnetic automatic locking/unlocking mechanisms, electromagnetic automatic locking/unlocking mechanisms, electro-mechanical automatic locking/unlocking mechanisms, optical automatic locking/unlocking mechanisms, electro-optical automatic locking/unlocking mechanisms, magneto-optical automatic locking/unlocking mechanisms, and electronic automatic locking/unlocking mechanisms.

The locking or unlocking of the locking/unlocking components and means, for example, locking/unlocking assembly 140, of the access opening, is performed, preferably, automatically, and by interfacing and communicating with, and being controlled by, a work station, for example, work station 150, as illustrated in FIGS. 1 and 3. In a corresponding manner, the corresponding system, for example, system 10, of the present invention, optionally, additionally includes a work station, for example, work station 150, for interfacing and communicating with, and controlling, the locking or unlocking of the locking/unlocking components and means, for example, locking/unlocking assembly 140, of the access opening, being performed automatically.

In general, the work station, for example, work station 150, includes any number and kinds or types of human operators, or/and includes any number and kinds or types of fully automatic or/and semi-automatic mechanized type operators. Moreover, the work station includes any number and kinds or types of fixed or/and portable (mobile) computers or/and computerized equipment, and computer software, and includes any number and kinds or types of fixed or/and portable (mobile) communication equipment (e.g., land-line phones or/and mobile or cellular phones, and associated software components thereof), which may be needed for on-site (locally) or/and off-site (distantly) performing the interfacing, communicating, and controlling, of the automatically locking or unlocking of the locking/unlocking components and means, of the access opening.

The interfacing, communicating, and controlling, of the automatically locking or unlocking of the locking/unlocking components and means, of the access opening, is performed, preferably, by using an interface, communication, and control, unit, being operatively connectable, for example, via at least one interface/communication/control signal line, to the locking/unlocking components and means, and operatively connectable, for example, via at least one interface/communication/control signal line, to the work station. In a corresponding manner, the corresponding system of the present invention, optionally, additionally includes an interface, communication, and control, unit, being operatively connectable, for example, via at least one interface/communication/control signal line, to the locking/unlocking components and means, and operatively connectable, for example, via at least one interface/communication/control signal line, to the work station. The interface, communication, and control, unit, enables the work station to perform the interfacing, communicating, and controlling, of the automatically locking or unlocking of the locking/unlocking components and means, of the access opening.

For example, as illustrated in FIGS. 1 and 3, the interfacing, communicating, and controlling, of the automatically locking or unlocking of the locking/unlocking components and means, for example, locking/unlocking assembly 140, of the access opening, is performed via interface, communication, and control, unit (ICC unit) 160, being operatively connectable, for example, via at least one interface/communication/control signal line 145, to the locking/unlocking components and means, for example, locking/unlocking assembly 140, and operatively connectable, for example, via interface/communication/control signal line 155, to work station 150. Operative connection of at least one interface/communication/control signal line 145 to locking/unlocking assembly 140, is also illustrated in FIGS. 2A-2D, for each alternative embodiment of the method and corresponding system, system 10, including a respective different specific type of access opening 30, 32, 34, or 36.

In the method and corresponding system of the present invention, the preceding illustratively described interfacing, communicating, and controlling, of the automatically locking or unlocking of the locking/unlocking components and means, of the access opening, is effected according to a temporal mode or/and protocol selected from the group consisting of a temporally continuous mode or/and protocol, a temporally discontinuous (i.e., periodic or sporadic) mode or/and protocol, and a combination thereof. According to specific need or/and application of the present invention, the actual continuous, discontinuous, or combination, temporal mode or/and protocol that is used, is either set or established in advance, such as in a pre-determined or scheduled manner, or is instantaneously set or established at a given instant, such as in an instantaneous or 'on-the-fly' manner.

Additionally, in the method and corresponding system of the present invention, the preceding illustratively described interfacing, communicating, and controlling, of the automatically locking or unlocking of the locking/unlocking components and means, of the access opening, is effected according to a mode or/and protocol selected from the group consisting of a wired mode or/and protocol, a wireless mode or/and protocol, and a combination thereof. According to the particular mode or protocol used for effecting the interfacing, communicating, and controlling, of the automatically locking or unlocking of the locking/unlocking components and means, of the access opening, there is using corresponding hardware equipment, peripheral devices, and components, and corresponding software.

Automatic 'In-Situ' Testing or/and Monitoring the Quality or/and Quantity of the Decoy Material in the Operative Trap The method of the present invention, further includes the optional, additional step of automatically in-situ testing or/and monitoring the quality or/and quantity (amount) of the decoy material in the mounted (and aligned or non-aligned) trap.

Accordingly, for example, with reference to FIGS. 1, 3, and 4, the method of the present invention further includes the optional, additional step of automatically in-situ testing or/and monitoring the quality or/and quantity (amount) of decoy material 22 in mounted (and aligned or non-aligned) trap 20.

The automatically in-situ (i.e., inside the trap) testing or/and monitoring the quality or/and quantity (amount) of the decoy material in the mounted (and aligned or non-aligned) trap, is performed by testing or/and monitoring pre-determined parameters of physical, chemical, or/and biological, properties, characteristics, and behavior (activity), or/and, level (height), of the decoy material therein.

As for any liquid phase or/and solid phase material or substance, the decoy material (which may be the same as, or different from, the protected material inside the container) in the mounted (and aligned or non-aligned) trap exhibits and may be characterized by a wide variety of different types or kinds of physical, chemical, or/and biological properties, characteristics, and behavior (activity). Depending upon the actual types or kinds of material(s) or substance(s) making up the decoy material, several exemplary physical, chemical, or/and biological properties, characteristics, and behavior (activity), of the decoy material, are: density, viscosity (i.e., for the decoy material being a viscous liquid), electrical conductivity, electrical resistivity, dielectric strength, pH, salt content or concentration (i.e., salinity), water (moisture) content or concentration, gas (e.g., water vapor, oxygen, carbon dioxide, nitrogen) content or concentration, organic (e.g., hydrocarbon) content or concentration, inorganic (e.g., sulfur, phosphorous, metals) content or concentration, microbial (e.g., bacteria) content or concentration, viral (e.g., virus) content or concentration, and biological activity (or inactivity).

The optional, additional step of automatically in-situ testing or/and monitoring the quality or/and quantity (amount) of the decoy material in the mounted (and aligned or non-aligned) trap, is performed by using, for example, a material quality or/and quantity testing or/and monitoring assembly, being operatively connectable to the mounted (and aligned or non-aligned) trap, and operatively contactable with the decoy material therein. In a corresponding manner, the corresponding system, and corresponding device (i.e., trap), of the present invention, each, optionally, additionally includes a material quality or/and quantity testing or/and monitoring assembly, being operatively connectable to the mounted (and aligned or non-aligned) trap, and operatively contactable with the decoy material therein, for automatically in-situ testing or/and monitoring the quality or/and quantity (amount) of the decoy material in the mounted (and aligned or non-aligned) trap.

Accordingly, for example, with reference to FIGS. 1, 3, and 4, the automatically in-situ testing or/and monitoring the quality or/and quantity (amount) of decoy material 22 in mounted (and aligned or non-aligned) trap 20, is performed by using a material quality or/and quantity testing or/and monitoring assembly, for example, material quality or/and quantity testing or/and monitoring assembly 170, being operatively connectable to mounted (and aligned or non-aligned) trap 20, and operatively contactable with decoy material 22 therein.

It is worthy to note that, in a non-limiting manner, the 'initial' operative connection of the material quality or/and quantity testing or/and monitoring assembly, for example, material quality or/and quantity testing or/and monitoring assembly 170, to trap 20 is made either before or after trap 20 is aligned with access opening 18, or/and mounted within container 16, according to hereinabove illustratively described Steps (b) and (c), respectively. Thereafter, following the initial operative connection, the intended operation of the material quality or/and quantity testing or/and monitoring assembly, for example, material quality or/and quantity testing or/and monitoring assembly 170, is wherein the material quality or/and quantity testing or/and monitoring assembly is operatively connectable to the mounted (and aligned or non-aligned) trap 20, and operatively contactable with decoy material 22 therein.

In general, the automatically in-situ testing or/and monitoring the quality or/and quantity (amount) of decoy material 22 in mounted trap 20 may be performed for mounted trap 20 being aligned with access opening 18, or, alternatively, for mounted trap 20 being non-aligned with access opening 18. The 'aligned' embodiment is particularly useful for those instances when system 10 is in 'active' operation for actively protecting material 12. Alternatively, the 'non-aligned' embodiment is particularly useful for those instances when system 10 is not in 'active' operation for actively protecting material 12, wherein system 10 can be readily subjected to maintenance or/and service by authorized personnel, for example, for inspecting, repairing, or/and replacing, trap 20 or/and trap mounting means 100-114 or/and optional material quality or/and quantity testing or/and monitoring assembly 170, as well as for inspecting, adding, removing, or replacing, decoy material 22 inside of trap 20.

As previously illustratively described hereinabove, with reference to FIGS. 1, 3, and 4, in Step (b), for aligning trap 20 with access opening 18 of container 16, preferably, trap 20 is aligned with access opening 18 in a particular manner such that the maximum possible view or range of sight (represented in FIGS. 1, 3, and 4, by the visual volume or space 92 encompassed by, and included in between, dashed lines 92*a* and 92*b*) of the perpetrator of the unauthorized or illegal act, before, during, and after, the time of committing the unauthorized or illegal act, is limited to that of only the exposed portion of decoy material 22 inside trap 20, whereby all of the mounting components of the trap, and all of protected material 12 inside container 16, are entirely outside of this view or range of sight of perpetrator (child, teenager, or animal).

Thus, the material quality or/and quantity testing or/and monitoring assembly, for example, material quality or/and quantity testing or/and monitoring assembly 170, is, preferably, operatively connectable to mounted (and aligned or non-aligned) trap 20, and operatively contactable with decoy material 22 therein, in a manner such that the maximum possible view or range of sight (visual volume or space 92 encompassed by, and included in between, dashed lines 92*a* and 92*b*) of the perpetrator of the unauthorized or illegal act, before, during, and after, the time of committing the unauthorized or illegal act, is limited to that of only the exposed portion of decoy material 22 inside trap 20, whereby all of the mounting components of trap 20, as well as optional material quality or/and quantity testing or/and monitoring assembly 170, and all of protected material 12 inside container 16, are entirely outside of this view or range of sight of perpetrator (child, teenager, or animal).

In the method, corresponding system, for example, system 10, and corresponding device, for example, device (trap) 20, of the present invention, the material quality or/and quantity testing or/and monitoring assembly, for example, material quality or/and quantity testing or/and monitoring assembly 170, is operative according to at least one type of automatic material testing or/and monitoring mechanism selected from the group consisting of electrical automatic material testing or/and monitoring mechanisms, magnetic automatic material testing or/and monitoring mechanisms, electromagnetic automatic material testing or/and monitoring mechanisms, electro-mechanical automatic material testing or/and monitoring mechanisms, optical automatic material testing or/and monitoring mechanisms, electro-optical automatic material testing or/and monitoring mechanisms, magneto-optical automatic material testing or/and monitoring mechanisms, and electronic automatic material testing or/and monitoring mechanisms.

The optional, additional step of automatically in-situ testing or/and monitoring the quality or/and quantity (amount) of decoy material 22 in mounted (and aligned or non-aligned) trap 20, is performed, preferably, by interfacing and communicating with, and being controlled by, a work station, for example, work station 150, as illustrated in FIGS. 1 and 3. In a corresponding manner, the corresponding system, for example, system 10, of the present invention, optionally, additionally includes a work station, for example, work station 150, for interfacing and communicating with, and controlling, the automatically in-situ testing or/and monitoring the quality or/and quantity (amount) of decoy material 22 in mounted (and aligned or non-aligned) trap 20. In a corresponding manner, the corresponding device, device (trap) 20, of the present invention, optionally, is operatively connectable to a work station, for example, work station 150, for interfacing and communicating with, and controlling, the automatically in-situ testing or/and monitoring the quality or/and quantity (amount) of decoy material 22 in mounted (and aligned or non-aligned) trap 20.

In general, the work station, for example, work station 150, includes any number and kinds or types of human operators, or/and includes any number and kinds or types of fully automatic or/and semi-automatic mechanized type operators. Moreover, the work station includes any number and kinds or types of fixed or/and portable (mobile) computers or/and computerized equipment, and computer software, and includes any number and kinds or types of fixed or/and portable (mobile) communication equipment (e.g., land-line phones or/and mobile or cellular phones, and associated software components thereof), which may be needed for on-site (locally) or/and off-site (distantly) performing the interfacing, communicating, and controlling, of the automatically in-situ testing or/and monitoring the quality or/and quantity (amount) of the decoy material in the mounted (and aligned or non-aligned) trap.

The interfacing, communicating, and controlling, of the automatically in-situ testing or/and monitoring the quality or/and quantity (amount) of the decoy material in the mounted (and aligned or non-aligned) trap, is performed, preferably, by using an interface, communication, and control, unit, being operatively connectable, for example, via at least one interface/communication/control signal line, to the material quality or/and quantity testing or/and monitoring assembly, and operatively connectable, for example, via at least one interface/communication/control signal line, to the work station. In a corresponding manner, the corresponding system, and corresponding device, of the present invention, each, optionally, additionally includes an interface, communication, and control, unit, being operatively connectable, for example, via at least one interface/communication/control signal line, to the material quality or/and quantity testing or/and monitoring assembly, and operatively connectable, for example, via at least one interface/communication/control signal line, to the work station. The interface, communication, and control, unit, enables the work station to perform the interfacing, communicating, and controlling, of the automatically in-situ testing or/and monitoring the quality or/and quantity (amount) of the decoy material in the mounted (and aligned or non-aligned) trap.

For example, as illustrated in FIGS. 1, 3, and 4, the interfacing, communicating, and controlling, of the automatically in-situ testing or/and monitoring the quality or/and quantity (amount) of the decoy material in the mounted (and aligned or non-aligned) trap, is performed by using interface, communication, and control, unit (ICC unit) 160, being operatively connectable, for example, via at least one interface/communication/control signal line 175, to material quality or/and quantity testing or/and monitoring assembly 170, and operatively connectable, for example, via interface/communication/control signal line 155, to work station 150.

In the method, corresponding system, and corresponding device (trap), of the present invention, the preceding illustratively described interfacing, communicating, and controlling, of the automatically in-situ testing or/and monitoring the quality or/and quantity (amount) of the decoy material in the mounted (and aligned or non-aligned) trap, is effected according to a temporal mode or/and protocol selected from the group consisting of a temporally continuous mode or/and protocol, a temporally discontinuous (i.e., periodic or sporadic) mode or/and protocol, and a combination thereof. According to specific need or/and application of the present invention, the actual continuous, discontinuous, or combination, temporal mode or/and protocol that is used, is either set or established in advance, such as in a pre-determined or scheduled manner, or is instantaneously set or established at a given instant, such as in an instantaneous or 'on-the-fly' manner.

Additionally, in the method, corresponding system, and corresponding device (trap), of the present invention, the preceding illustratively described interfacing, communicating, and controlling, of the automatically in-situ testing or/and monitoring the quality or/and quantity (amount) of the decoy material in the mounted (and aligned or non-aligned) trap, is effected according to a mode or/and protocol selected from the group consisting of a wired mode or/and protocol, a wireless mode or/and protocol, and a combination thereof. According to the particular mode or protocol used for effecting the interfacing, communicating, and controlling, of the automatically in-situ testing or/and monitoring the quality or/and quantity (amount) of the decoy material in the mounted (and aligned or non-aligned) trap, there is using corresponding hardware equipment, peripheral devices, and components, and corresponding software.

In general, regardless of whether or not a perpetrator of an unauthorized or illegal act introduces an illicit substance or object via the access opening into the container, by automatically in-situ (i.e., inside the trap) testing or/and monitoring the quality or/and quantity (amount) of the decoy material in the mounted (and aligned) trap, in particular, by testing or/and monitoring pre-determined parameters of physical, chemical, or/and biological properties, characteristics, and behavior (activity), or/and, level (height), of the decoy material, there is providing an authorized person the capability to 'automatically' identify and determine the status, or any change thereof, of the quality or/and quantity (amount) of the decoy material inside the mounted (and aligned or non-aligned) trap, in particular, in terms of the physical, chemical, or/and biological properties, characteristics, and behavior (activity), or/and, level (height), of the decoy material inside the mounted (and aligned or non-aligned) trap.

By implementing the present invention for ensuring the protection and security of the protected material contained inside the container, then, in the event that a perpetrator of an unauthorized or illegal act introduces an illicit substance or object via the access opening into the container, the mounted (and aligned) trap with the decoy material intercepts and traps the illicit substance or object. Subsequently, depending upon the type and quantity of the illicit substance or object introduced and exposed to the decoy material in the trap, in particular, relative to the type and quantity of the decoy material in the trap, and also depending upon the extent or period of time during which the decoy material has been exposed and subjected to the physical, chemical, or/and biological properties, characteristics, and behavior (activity), of the illicit substance or object, then, the quality or/and quantity (amount) of the decoy material, in particular, in terms of the physical, chemical, or/and biological properties, characteristics, and behavior (activity), or/and, level (height), of the decoy material, are expected to be perturbed or affected to at least some extent, and possibly, to a major extent.

Such perturbation or affecting of the quality or/and quantity (amount) of the decoy material, in particular, in terms of the physical, chemical, or/and biological properties, characteristics, and behavior (activity), or/and, level (height), of the decoy material, by introduction of the illicit substance or object into the mounted (and aligned) trap, is measurable and determinable by appropriate testing or/and monitoring, i.e., as just illustratively described hereinabove. Thus, for such a change in the quality or/and quantity (amount) of the decoy material inside the mounted (and aligned or non-aligned) trap, then, by automatically in-situ (i.e., inside the trap) testing or/and monitoring the quality or/and quantity (amount) of the decoy material inside the mounted (and aligned or non-aligned) trap, in particular, by testing or/and monitoring pre-determined parameters of physical, chemical, or/and biological properties, characteristics, and behavior (activity), or/and, level (height), of the decoy material, there is providing an authorized person with the capability to 'automatically' identify, determine, and analyze, a possible event of a break in the overall security environment of the protected material stored in the container.

As previously illustratively described hereinabove, with reference to FIGS. 1, 3, and 4, in general, decoy material 22 is essentially any type of liquid or/and solid phase material which is the same as, or different from, protected material 12 that is currently contained and stored, or that is intended to be contained and stored, in container 16. Preferably, decoy material 22 is the same as protected material 12 that is currently contained and stored, or that is intended to be contained and stored, in container 16, in order to maximize generation of the above previously illustratively described protective type of visual illusion directed against the perpetrator of the unauthorized or illegal act introducing illicit substance or object 14 via access opening 18 into container 16.

According to the embodiment of the present invention wherein decoy material 22 in mounted (and aligned or non-aligned) trap 20 is 'the same as' protected material 12 that is currently contained and stored, or that is intended to be contained and stored, in container 16, then, except for the fact that the quantity (amount) of decoy material 22 inside the mounted (and aligned or non-aligned) trap 20 is significantly less than the quantity (amount) of protected material 12 contained and stored in container 16, decoy material 22 inside trap 20 corresponds to, and represents, a scaled down form of 'mini-environment' compared to the 'macro-environment' of protected material 12 contained and stored in container 16.

For such an embodiment of the present invention, the physical, chemical, or/and biological properties, characteristics, and behavior (activity), or/and, level (height), of decoy material 22 inside the mounted (and aligned or non-aligned) trap 20 (i.e., inside the micro-environment), are expected to be 'essentially identical' to, or at least very similar to, and representative of, or proportional to, those of protected material 12 contained and stored in container 16 (i.e., inside the macro-environment). Thus, the status, or any change thereof, of the physical, chemical, or/and biological properties, characteristics, and behavior (activity), or/and, level (height), of decoy material 22 inside the mounted (and aligned or non-aligned) trap 20, is expected to be 'essentially identical' to, or at least very similar to, and representative of or proportional to, the status, or any change thereof, of the physical, chemical, or/and biological properties, characteristics, and behavior (activity), or/and, level (height), protected material 12 contained and stored in container 16.

Therefore, for such an embodiment of the present invention, by automatically in-situ (i.e., inside the trap) testing or/and monitoring the quality or/and quantity (amount) of the decoy material inside the mounted (and aligned or non-aligned) trap (i.e., inside the micro-environment), in particular, by testing or/and monitoring pre-determined parameters of physical, chemical, or/and biological properties, characteristics, and behavior (activity), or/and, level (height), of the decoy material, there is providing an authorized person the capability to 'automatically' identify and determine the status, or any change thereof, of the quality or/and quantity (amount) of the protected material contained and stored in the container (i.e., inside the macro-environment).

Thus, as illustratively described hereinabove, the method, corresponding system, and corresponding device, of the present invention provide novel, inventive, and highly effective, security conditions, whereupon following a break in the overall security environment of a stored material, operation of the invention prevents contamination of the material by unauthorized or illegal introduction of an illicit substance or object into the storage container.

Moreover, and relatedly, as a direct result of the present invention being implemented for preventing the protected material from becoming contaminated by introduction of an illicit substance or object into the storage container, there is preventing potential damage to infrastructure or/and injury (including possible death) of humans which would have been caused by exposure of these entities to the contaminated material following possible release of the contaminated material from the storage environment. Furthermore, implementation of the present invention prevents occurrence of a bad scenario involving release of a contaminated material, by preventing a situation of mass destruction of infrastructure or/and mass injury (including death) of humans, for example, on the order comparable to the effects of a 'weapon of mass destruction' (WMD).

Based upon the above indicated aspects of novelty and inventiveness, and, beneficial and advantageous aspects, characteristics, or features, the present invention successfully addresses and overcomes limitations, and widens the scope, of presently known types of conventional or/and high-tech security environments, conditions, and arrangements, employing known types of security equipment or hardware and security procedures, used for protecting a material from contamination by an illicit substance or object as a result of an unauthorized or illegal act, such as that performed by children, teenagers, as well as that often performed by animals, such as by birds or insects or/and by small land animals, for example, rodents, squirrels, and snakes.

The above previously described prior art types of conventional or/and high-tech security environments, conditions, and arrangements, used for protecting a material from contamination by an illicit substance or object as a result of an unauthorized or illegal act, such as that performed by children, teenagers, or/and animals, are primarily focused on discovering, identifying, and targeting, the break in security, and to a certain extent, also to slow down, impede, or obstruct, further progress or duration of, the break in security. However, once contamination by the unauthorized introduction of the illicit substance or object into the material is made, for example, via an access opening in the cover of the container, 'the clock starts ticking' regarding potential or actual damage to infrastructure or/and injury (including possible death) of humans caused by exposure of these entities to the contaminated material, following release of the contaminated material from the broken security storage environment.

In strong contrast, implementation of the present invention precludes starting of such a ticking clock. Moreover, once installed, operation of the present invention requires no human interaction for preventing the illicit substance or object from coming into contact with the material inside the container.

The present invention is generally applicable to essentially any type and quantity, particularly large volumes, of liquid or/and solid phase material, is generally applicable to essentially any type, and, to essentially any geometrical shape or configuration and dimensions, of storage containers, is relatively inexpensive to fully implement, is readily implemented in new or existing storage environments, and is commercially applicable.

The present invention, as either part of or separate from, ensuring the protection and security of the material, optionally, may additionally be implemented for automatically in-situ testing or/and monitoring the quality or/and quantity (amount) of the decoy material in the mounted (and aligned or non-aligned) trap, in particular, by testing or/and monitoring pre-determined parameters of physical, chemical, or/and biological, properties, characteristics, and behavior (activity), or/and, level (height), of the decoy material therein.

It is appreciated that certain aspects and characteristics of the invention, which are, for clarity, described in the context of separate embodiments, may also be provided in combination in a single embodiment. Conversely, various aspects and characteristics of the invention, which are, for brevity, described in the context of a single embodiment, may also be provided separately or in any suitable subcombination.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the scope of the appended claims.

What is claimed is:

1. A method for protecting a material from contamination by an illicit substance or object, comprising the steps of:

(a) providing the material inside a closed container having an access opening;

(b) aligning a trap with said access opening;

(c) mounting said aligned trap within said container, such that said aligned trap is interposed between said access opening and at least a portion of the material; and (d) adding an amount of decoy material to said trap, such that said trap with said decoy material intercepts and traps the illicit substance or object introduced via said access opening into said container, thereby preventing the illicit substance or object from coming into contact with the protected material inside said container.

2. The method of claim 1, wherein the material in said container is selected from the group consisting of a liquid phase material, a solid phase material, and a combination thereof.

3. The method of claim 1, wherein said trap is in a form of a tray or a tray-like structure.

4. The method of claim 1, wherein magnitude of each of length and width of said trap is in a range of between about 1.2 to about 2.0 times magnitude of corresponding length and width of said access opening.

5. The method of claim 1, wherein said trap includes a screen attached to and encompassing perimeter of, upper end or top portion of walls of said trap, for assisting said trap for said intercepting and said trapping the illicit substance or object.

6. The method of claim 1, wherein step (b) is performed according to a specifically designed three-dimensional geometrical and dimensional relative configuration, accounting for geometrical shape or configuration and dimensions of said trap relative to geometrical shape or configuration and dimensions of said access opening, to generate a protective type of visual illusion directed against a perpetrator of the unauthorized or illegal act introducing the illicit substance or object via said access opening into said container.

7. The method of claim 1, wherein step (b) is performed in a manner such that maximum possible view or range of sight of a perpetrator of the unauthorized or illegal act is limited to only exposed portion of said decoy material inside said trap, whereby all mounting components of said trap, and all of said protected material inside said container, are entirely outside of said view or range of sight of said perpetrator.

8. The method of claim 1, wherein step (b) is performed in a manner such that said trap is co-axially aligned with said access opening of said container, whereby central longitudinal axis of said trap is aligned and coincident with central longitudinal axis of said access opening, such that said trap and said access opening have same said central longitudinal axis.

9. The method of claim 1, wherein said trap is held and mounted in a trap holder within said container.

10. The method of claim 9, wherein magnitude of each of length and width of said trap holder is in a range of between about 1.01 to about 1.5 times magnitude of corresponding length and width of said trap.

11. The method of claim 1, wherein step (c) said aligned trap is mounted within said container according to a fixed, non-movable mounting configuration relative to said access opening.

12. The method of claim 1, wherein step (c) said aligned trap is mounted within said container according to a non-fixed, movable mounting configuration relative to said access opening.

13. The method of claim 1, wherein step (d) said decoy material is selected from the group consisting of a liquid phase material, a solid phase material, and a combination thereof.

14. The method of claim 1, wherein said access opening is operatively connected to closure or covering components and means, for partially or entirely closing or covering, and for re-opening, said access opening.

15. The method of claim 14, further comprising the step of automatically sensing an opened or closed configuration, and extent thereof, of said closure or covering components and means of said access opening.

16. The method of claim 15, wherein said automatically sensing is performed by using an opened/closed configuration type of sensing assembly, operatively connectable to said access opening, or/and operatively connectable to said closure or covering components and means of said access opening.

17. The method of claim 16, wherein said opened/closed configuration type of sensing assembly is operative according to at least one type of automatic sensing mechanism selected from the group consisting of electrical automatic sensing mechanisms, magnetic automatic sensing mechanisms, electromagnetic automatic sensing mechanisms, electro-mechanical automatic sensing mechanisms, optical automatic sensing mechanisms, electro-optical automatic sensing mechanisms, magneto-optical automatic sensing mechanisms, and electronic automatic sensing mechanisms.

18. The method of claim 15, wherein said automatically sensing is performed by interfacing and communicating with, and being controlled by, a work station.

19. The method of claim 18, wherein said interfacing, communicating, and controlling, of said automatically sensing, is performed by using an interface communication, and control, unit, operatively connectable to said opened/closed configuration sensing assembly, and operatively connectable to said work station.

20. The method of claim 18, wherein said interfacing, communicating, and controlling, of said automatically sensing, is effected according to a mode or/and protocol selected from the group consisting of a wired mode or/and protocol, a wireless mode or/and protocol, and a combination thereof.

* * * * *